US010900272B2

(12) United States Patent
Glickman et al.

(10) Patent No.: US 10,900,272 B2
(45) **Date of Patent: *Jan. 26, 2021**

(54) ONE-PIECE SILL PAN FLASHING

(71) Applicant: Sill Dry Industries, LLC, Hatfield, PA (US)

(72) Inventors: Joel I. Glickman, Jupiter, FL (US); Kieran McMahon, Ambler, PA (US)

(73) Assignee: Sill Dry Industries, LLC, Hatfield, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/566,429

(22) Filed: Sep. 10, 2019

(65) Prior Publication Data

US 2020/0002999 A1 Jan. 2, 2020

Related U.S. Application Data

(63) Continuation-in-part of application No. PCT/US2018/029100, filed on Apr. 24, 2018.
(Continued)

(51) Int. Cl.

| | |
|---|---|
| ***E06B 1/62*** | (2006.01) |
| ***E06B 1/68*** | (2006.01) |
| ***E06B 3/30*** | (2006.01) |
| ***E06B 3/96*** | (2006.01) |
| ***E06B 7/22*** | (2006.01) |

(Continued)

(52) U.S. Cl.
CPC ..... *E06B 1/62* (2013.01); *E06B 1/14* (2013.01); *E06B 1/68* (2013.01); *E06B 1/702* (2013.01); *E06B 3/308* (2013.01); *E06B 3/9632* (2013.01); *E06B 7/22* (2013.01); *E06B 2001/628* (2013.01)

(58) Field of Classification Search
CPC . E06B 3/9632; E06B 7/22; E06B 7/14; E06B 1/702; E06B 1/705; E06B 3/308; E06B 2001/628; E06B 1/62; E06B 1/70; E06B 1/665; E06B 7/26
See application file for complete search history.

(56) References Cited

U.S. PATENT DOCUMENTS

| | | | |
|---|---|---|---|
| 1,677,130 | A | 7/1928 | Cherry |
| 5,072,552 | A | 12/1991 | Sauder |

(Continued)

FOREIGN PATENT DOCUMENTS

| | | | |
|---|---|---|---|
| WO | 2018200491 | A1 | 11/2018 |

*Primary Examiner* — Jessie T Fonseca
(74) *Attorney, Agent, or Firm* — St. Onge Steward Johnston & Reens, LLC

(57) ABSTRACT

A one-piece sill pan flashing is provided with accordion sections enabling the flashing to be adjusted in width as necessary for installation in rough framing. The new flashing includes a sill plate cover with forwardly and downwardly inclined upper portions and lower portions extending downward from the upper portions. The accordion sections are incorporated integrally into the sill cover and are formed of narrow panels, flexibly connected along lateral edges to form V-shaped accordion folds having a series of ridges and valleys. The respective ridges and valleys are aligned in common vertical planes and are rounded through a transition curve at the front corners thereof. The flashing is injection molded in two end parts, each with one or more accordion sections. Center extensions can be used for extra wide window framing. The parts are permanently bonded and sealed at the factory and shipped and installed as one piece.

18 Claims, 21 Drawing Sheets

Related U.S. Application Data

(60) Provisional application No. 62/734,630, filed on Sep. 21, 2018.

(51) Int. Cl.
*E06B 1/70* (2006.01)
*E06B 1/14* (2006.01)

(56) References Cited

U.S. PATENT DOCUMENTS

| | | | |
|---|---|---|---|
| 5,581,959 | A | 12/1996 | Occhipinti |
| 6,122,874 | A | 9/2000 | Smerilli |
| 6,681,530 | B1 | 1/2004 | Givens |
| 7,222,462 | B2 | 5/2007 | Ellingson |
| 7,351,296 | B2 | 4/2008 | Waggoner et al. |
| 7,673,426 | B2 | 3/2010 | Broad et al. |
| 7,676,996 | B2 | 3/2010 | Teodorovich |
| 7,775,004 | B2 | 8/2010 | Allen |
| 7,788,855 | B2 | 9/2010 | Mileti et al. |
| 7,877,945 | B2 | 2/2011 | Eggen et al. |
| 8,117,789 | B2 | 2/2012 | Teodorovich |
| 8,443,554 | B1 | 5/2013 | Teodorovich |
| 8,561,357 | B2 | 10/2013 | Teodorovich |
| 8,695,293 | B2 | 4/2014 | Teodorovich |
| 9,982,477 | B1 | 5/2018 | Glickman et al. |
| 10,024,097 | B1 | 7/2018 | Glickman et al. |
| 2005/0217189 | A1 | 10/2005 | Moffitt |
| 2006/0101726 | A1 | 5/2006 | Collins |
| 2008/0229676 | A1 | 9/2008 | Allen |
| 2009/0056241 | A1 | 3/2009 | Koessler et al. |
| 2009/0272045 | A1 | 11/2009 | Teodorovich |
| 2010/0058683 | A1 | 3/2010 | Bushberger |

ONE-PIECE SILL PAN FLASHING

FIELD OF THE INVENTION

The invention relates generally to the field of home and office construction and more particularly to a novel and improved sill pan flashing for installation at the bottom of the rough framing of a window or door opening in order to prevent penetration of water underneath a window or door unit and into the underlying framing structure.

BACKGROUND OF THE INVENTION

In the home construction industry, it is typical for windows and doors to be constructed as independent, prefabricated units and installed in framed openings constructed in the exterior walls of the home. The exterior framing of a typical prefabricated window unit overlaps the exterior of the housing wall around the framed openings and initially is sealed to prevent access of moisture. Over time the sealing material may deteriorate and allow some moisture to penetrate. This can result in deterioration of the wood framing and of housing structure below the framed opening. Accordingly, in many such structures it is the practice to install a sill pan flashing between the bottom of the prefabricated window unit and the underlying sill plate of the framing. The sill pan flashing is formed of a suitable plastic or metal material and serves to direct any collected water outward to the exterior of the siding. Examples of earlier forms of such sill pan flashing devices are shown in U.S. Pat. Nos. 1,677,130, 7,222,462, 7,673,426, and 8,443,554.

A typical framed window opening includes a horizontal sill plate and spaced apart vertical elements, joined to opposite ends of the sill plate and extending upward therefrom. The upper ends of the vertical elements are joined to a header member, which extends horizontally between the vertical members and forms a closed opening, usually of rectangular configuration, in which a prefabricated window unit can be received. The elements comprising the framed opening typically may be formed of 2"×4" (50.8 mm×101.6 mm) or 2"×6" (50.8 mm×152.4 mm) lumber. In addition, a rough siding typically is secured to the exterior framing of the structure, and an opening is cut into the rough siding in the size and shape to coincide with the framed opening. The rough siding may be of ½' (12.7 m) or ¾' (19.1 mm) plywood, for example.

A sill pan flashing of typical construction includes a sill cover arranged to extend over the full width of the sill plate. The sill cover is tilted forwardly to allow water to drain forwardly toward the exterior of the structure. Typically, a front structure extends downward a short distance at the front of the sill cover to guide the flow downward over the outer surface of the finished structure. A front flange or panel of the flashing typically extends laterally a few inches beyond the sides of the opening so as to cover a small front area of the rough siding. Portions of the front panel also extend upwardly a few inches above the level of the sill plate at each side of the opening. Side panels also extend upward a few inches from each end of the sill cover and overlie lower portions of the vertical framing members. The side panels are joined at their front vertical edges with the upwardly extending portions of the front panel to form closed and self-supporting corner structures at opposite sides of the framed opening.

It is standard construction practice to build rough-framed window openings to dimensions somewhat larger than the standard dimensions of the prefabricated window units to be inserted therein. Window manufacturers recommend that the opening defined by the framing be a half to three-quarters inch larger than the nominal size of the prefabricated window unit. In actual practice it is common for the dimensions of the rough framing to vary significantly from the recommended tolerances, anywhere from a half to three-quarters inch smaller to more than an inch larger than recommended. This presents a problem with respect to the installation of the sill pan flashings, because the required width of the flashing, in order to fit snuggly between the vertical elements of the frame, may be different for each of many framed openings that are "nominally" of the same size. Heretofore, this commonly has been dealt with by forming the sill pan flashings in two or three (sometimes more) pieces, which are assembled in the field to fit the individual openings. A two-piece assembly, for example, is made to fit the largest opening expected to be encountered in the field for a given nominal size window unit. Thus, a conventional two-piece sill pan flashing, intended for a window unit of nominal 24" (0.61 m) width, is dimensioned so that the pieces have a total width substantially greater than the "nominal" framing width of 25.5"-24.75" (0.648 m-0.629 m), enabling the two pieces to be assembled in the field in partially overlapping relation to fit an expected wider range of opening sizes of the rough framing. A sealant is applied in the field where the pieces overlap, to avoid leakage at the interface between the parts.

The above described procedures, while enabling the flashing to be fit suitably to the framed opening, have important disadvantages. Among them, the individual installation of the two (or more) components, and the sealing of the interface(s) between them consumes extra labor time and thus adds to the cost of construction. Also, a sealant is required to seal the joint(s) where the sill pan has more than one piece. Such sealed joints are often installed without the proper skill and care and are notorious for enabling leakage over time. The ASTM Manual relating to multi-piece flashing contains the statement at Section 5.16.4.2, "Warning—Sealant selection and application are critical to performance***."

It has been proposed heretofore to fabricate a sill pan flashing in one piece, sized suitably at a width greater than the maximum expected width of the rough opening. Such a proposal is found in the Broad et al. U.S. Pat. No. 7,673,426. Although the proposed one-piece flashing can be shipped to the job site as a single unit, it must be cut into two parts at the job site in order to fit the opening. The then two-piece assembly is overlapped and sealed during installation in the same manner as the above-described multi-piece assemblies, with all the disadvantages thereof, and with the addition of the cutting operation and the requirement of the necessary tools to perform the cutting operation.

There thus has been a long-felt need for an improved form of sill pan flashing that can be fabricated, shipped and installed in one piece with attendant reduction in labor costs and with greatly improved performance with respect to leakage over time. Significant improvements to the above described arrangements are represented by the inventions of our Glickman/McMahon U.S. Pat. Nos. 9,982,477 and 10,024,097, in which unique, one-piece flashings incorporate a form of accordion or bellows structure which allows the flashing to be adjusted in width during installation as necessary to fit the dimensions of the rough framing. The arrangement is such that the flashing can be constructed and shipped from the factory in one piece and installed at the job site without cutting and without the need for fitting, assembling and sealing two or more pieces over the sill plate in order to form a functional flashing. The installation of the flashing at the job site is greatly expedited since the flashing can be secured at one side of the framing, expanded in width as necessary to reach the opposite side, and then secured to the opposite side framing. The installation can be accomplished in a few seconds of time and is functionally far superior to multi-piece flashings that require manual sealing where the parts are joined.

SUMMARY OF THE INVENTION

Pursuant to the present invention, a novel and improved form of sill pan flashing is provided, which incorporates features of the before-mentioned Glickman/McMahon patents and further includes important new inventive concepts relating to the design of the accordion sections of the flashing as well as to the manufacture of the flashing on an efficient and economical basis. As with our previously patented designs, the improved sill pan flashing is fabricated at the factory in one piece, delivered to the job site in one piece, and installed in the window framing in one piece, with resultant savings from various sources, but with particular benefits in labor costs at the job site as well as greatly superior performance derived from the absence of need to seal an interface between individual parts. The sill pan flashing of the invention comprises corner structures at each side arranged to be seated against lower portions of the vertical elements of the framing, and a sill plate cover joined with the corner structures and forming therewith a continuous sill cover extending across the full width of the sill plate.

Pursuant to the invention the sill plate cover includes at least one, and preferably two or more accordion sections configured to allow for a predetermined amount of width adjustment of the flashing to fit the framing. The new flashing preferably is designed to a width that is somewhat less than the minimum width of a framed opening that can receive a prefabricated window unit of a given nominal width. The one or more accordion sections integrally incorporated into the sill cover of the flashing accommodate sufficient expansion of the width of the flashing to enable it to be fitted properly to the actual width of the framed opening during installation, regardless of the wide variations in such width typically encountered at the job site. In a typical installation procedure according to the invention, one of the corner structures is secured at one side of the rough framed opening, for example by self-tapping screws, nails or staples. Then the second end structure is urged laterally, expanding the width of the accordion section or sections until the second end structure engages the opposite side of the rough framing. The second corner structure is then fastened in place to complete the installation.

In one preferred embodiment of our invention, the flashing may be initially constructed in two parts, for typical window sizes, and in three or more parts for extremely wide window structures, with the flashing parts in all cases being permanently joined and sealed as one piece at the factory. The resulting one-piece flashing includes one or more accordion sections to accommodate the required expansion in width during installation at the job site. Preferably, all sections of the flashing are formed by injection molding of the same thermoplastic material, and the individual sections are permanently bonded and sealed at the factory.

In another preferred embodiment of the invention, one or more integrally molded accordion sections are formed of a rugged but flexible thermoplastic material in the form of a series of connected, generally V-shaped elements. The V-shaped elements preferably are comprised of a plurality of flexibly connected narrow panels, joined at their lateral edges by web sections which are relatively thin in relation to the thickness of the panels connected thereby and which form ridge and valley fold lines. The accordion sections have upper portions, inclined downwardly and forwardly at a shallow angle to horizontal, and lower portions connected to the upper portions and extending vertically downward. The forward corners of the accordion sections are generously rounded in the transition region from a vertical orientation to a shallow upward angle orientation, with the ridges and valleys of the individual vertical V-shaped elements being aligned with the ridges and valleys of the inclined upper V-shaped elements, including throughout the arcuate transition region at the front. With this unique, in-line configuration the cross sectional configuration of the individual V-shaped elements remains substantially constant throughout, which provides significant manufacturing benefits and functional advantages.

In another preferred embodiment of the invention, the ridges and valleys of the accordion sections are so positioned that the valley folds of accordion sections are positioned in or close to the planes of the adjacent panels of the sill cover, on the vertical portion of the flashing, and also on the front portion of the inclined upper portion thereof. As a result, the folds of the accordion sections project forward with respect to the adjacent front panels and upward with respect to the adjacent upper panels, at the front of the upper sill cover portion. At the rear of the upper sill cover, which is elevated well above the sill plate, the relationship is reversed, such that ridge folds of the accordion sections are in or close to the plane of the back portions of the upper sill cover panels and the individual accordion folds project downward with respect to adjacent sill cover panels.

In one preferred form of the invention, the flashing is initially formed by injection molding of separate left hand and right hand parts, each typically including one or more accordion sections, depending upon the desired overall width of the flashing. The two molded parts are formed with overlapping inner edge panels, which are permanently bonded and sealed at the factory, and the flashing is shipped and installed as one piece. For very wide window frames, one or more center extensions, typically without additional accordion sections, may be inserted between the left and right hand end parts. The parts are bonded and sealed at the factory, preferably by a process of linear friction welding, which results in surface-to-surface melt bonding of the parts to form a reliably permanent joint and seal.

The new flashing, in its various forms, is cost effective and functional throughout the manufacturing phase and is uniquely advantageous during installation and for long term protection of the structure in which it is installed.

For a more complete understanding of the above and other features and advantages of the invention, reference should be made to the following detailed description of preferred embodiments of the invention together with the accompanying drawings thereof.

DETAILED DESCRIPTION OF THE INVENTION

Figure 1:
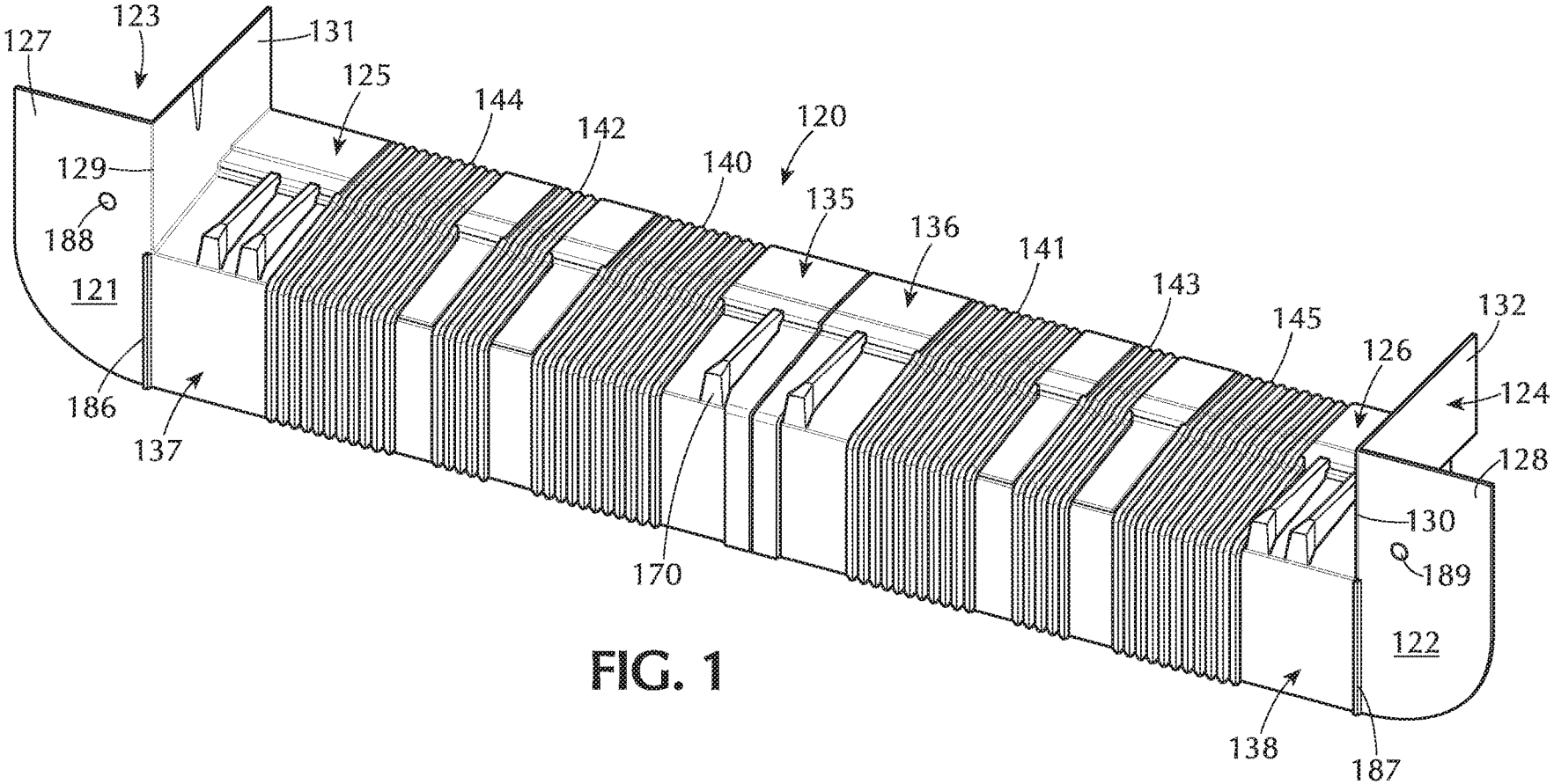
FIG. 1 is an orthographic view of a one-piece flashing according to the invention which includes a plurality of accordion sections to accommodate width adjustment during installation.
Figure 2:
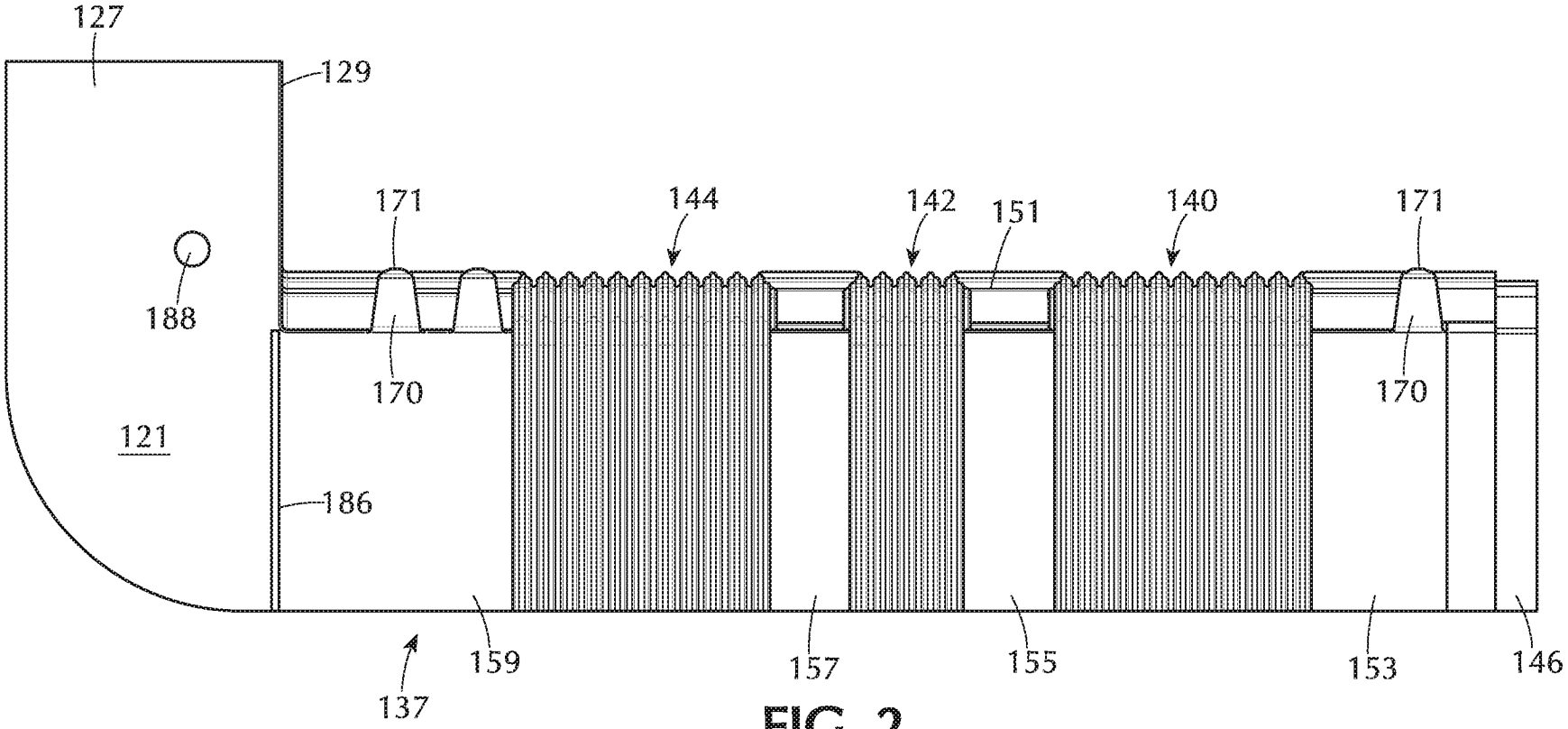
FIGS. 2 and 3 are front elevational views of left hand and right hand end parts, respectively, which, when joined together as one piece, form an advantageous embodiment of the invention of the form shown in FIG. 1.
Figure 3:
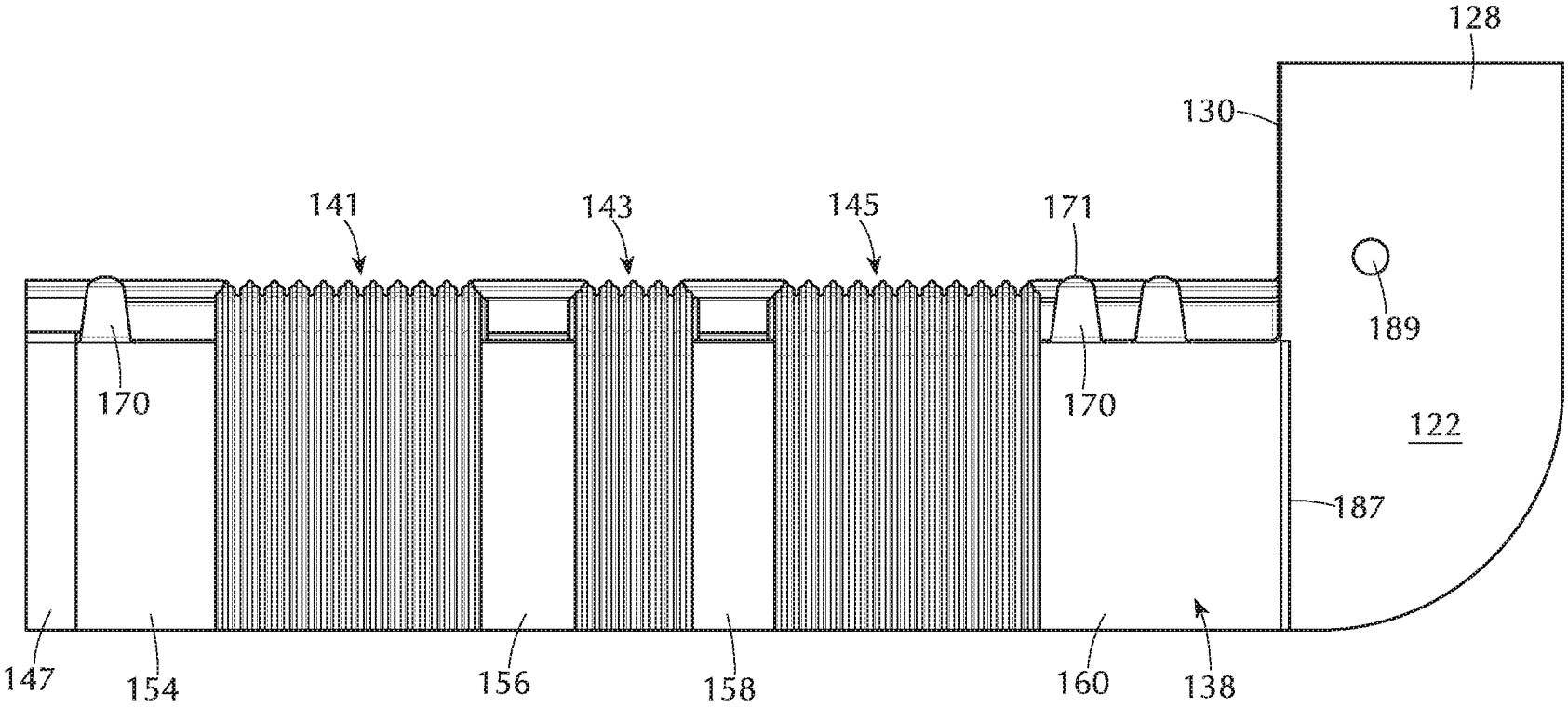

Referring now to the drawings, and initially to FIG. 1 thereof, the numeral 120 designates a sill pan flashing according to the invention which, for windows of typical size (e.g., 18", 24", 36"; 0.48 m, 0.61 m, 0.91 m) may be formed of two end parts 121, 122, which are permanently joined together as a single part. The two end parts 121, 122 preferably are formed by injection molding procedures, of a suitable thermoplastic material.

In the illustrated embodiment, the two end parts 121, 122 are comprised of corner structures 123, 124 at opposite sides and sill plate cover sections 125, 126 extending inwardly from each of the spaced apart corner structures. The two corner structures 123, 124 have front-facing vertical panels 127, 128 joined along vertical edges 129, 130 with laterally inwardly facing vertical panels 131, 132. These panels form self-supporting corner structures that are intended to engage and be secured to outer sheathing and/or spaced-apart upright members 133, 134 (FIG. 15) of a rough-framed opening of a suitable size and shape (typically rectangular) for the reception of a prefabricated window unit (not shown). The sill plate cover sections 125, 126 include forwardly and downwardly inclined top structures 135, 136 and vertical front structures 137. 138. When the unit is installed, the top structures 135, 136 will rest upon and cover the sill plate 139 (FIG. 15) of the rough-framed opening while the vertical front structures 137, 138 extend downward over the front of the sill plate and sheathing and typically farther downward over the tops of shingle, clapboard siding or the like so as to direct any water over the exterior of the structure.

In the first illustrated embodiment of the invention, intended for a 36 inch (0.91 m) window, the sill plate cover sections 125, 126 advantageously include a total of six accordion sections 140-145 (three on each side), to be described further, forming an important part of the invention. For smaller windows fewer accordion sections can be utilized. For example, for a 24" (0.61 m) window, the innermost accordion sections 140, 141 are removed. For an 18" (0.46 m) window, the two innermost accordion sections 140, 142 and 141, 143 are removed (see FIGS. 19, 20).

Figure 9:
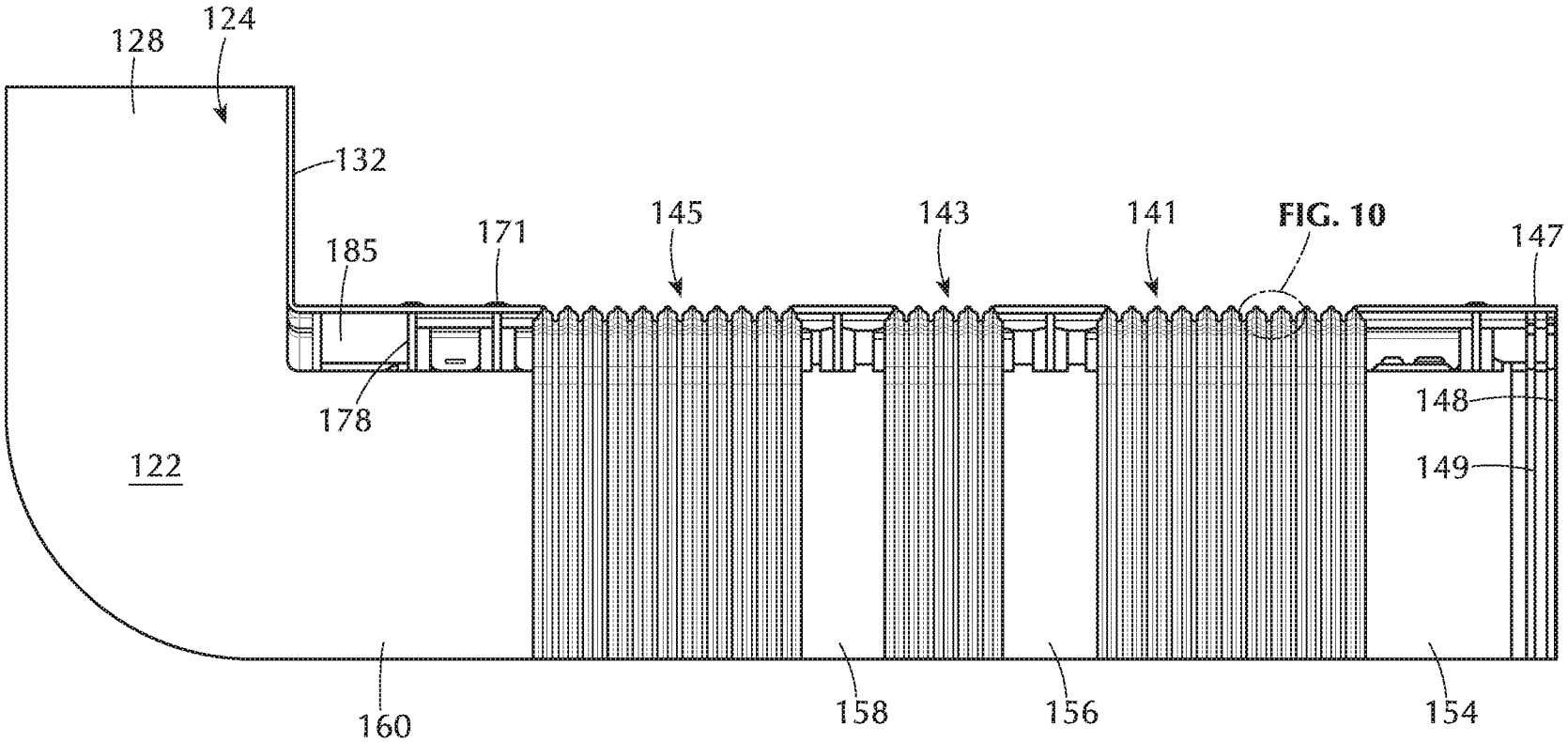

In accordance with an aspect of the invention, the two end parts 121, 122 of the flashing are individually formed by injection molding of a thermoplastic material. A particularly preferred such material is a thermoplastic olefin alloy, such as TPO-3985 UVP GLM Black, available from Washington Penn Plastic Co., Inc. of Washington Pa., US. This material is very tough and weather resistant and is extensively used in demanding automotive applications such as bumpers. The left end part 121 is formed at its inner end with an underlapping flange 146 while the right end part 122 is formed with an overlapping flange 147. As shown best in FIGS. 9 and 12, the overlapping flange 147 is formed with a pair of spaced apart, integrally molded parallel weld beads 148, 149 which extend continuously from the back edge of the flange 147 to its lower edge at the front of the flashing. The weld bead 148 extends along and partly defines the inner edge of the overlapping flange 147. The two end parts 121, 122 of the flashing are permanently joined and sealed by a known linear vibration welding procedure in which the two end parts are secured in aligned relation, with the weld beads 148, 149 overlapped on the underlapping flange 146. While the parts are so held and positioned, the two parts are vibrated laterally at high frequency until the heat of friction causes melting of the contacting surfaces of the weld beads and the underlapping flange 146. The vibration is then terminated and the two parts are held under pressure for a few moments while the melted surfaces cool and fuse. This procedure assures long term integrity and permanence of the structure and the seal. Desirably, a small space may be provided between the abutting edges of the two end parts 121, 122 to receive and contain molten plastic that may be extruded during the procedure.

In the device of the invention, the top structures 135, 136 are disposed at an upward-rearward incline, preferably of 7° or 8°. In the illustrated embodiment, which is dimensioned to be received over a nominal 6 inch (152 mm) sill plate 139, an inclined front portion 150 (FIG. 16) extends rearward for about 3.75 inches (95 mm) from the front, at which point there is an abrupt, substantially vertical rise of about $1/8^{th}$ inch (3.2 mm), noted at 151 in FIGS. 15, 16, which functions as a dam or barrier to prevent rearward flow of water driven by extreme wind pressures. To the rear of the rise 151 the 7°-8° incline continues for about ¾ inch (19 mm) at 150*a*, providing an additional approximately 3/32 inch (2.4 mm) of rise, after which the top surface 152 extends horizontally to the back edge. Preferably, the rise of the inclined front portion 150, from the front to the abrupt rise 151, is at least 0.5 inch (12.7 mm). It can be noted that for a flashing intended for a nominal 2×4 (51 mm×102 mm) sill plate, the configuration reflected in FIGS. 15, 16 can be the same except that the horizontal rearward extension is reduced in length correspondingly, to perhaps 3/16 inch (4.76 mm).

Desirably, the back portions of the flashing are configured to extend rearward sufficiently to engage the internal sheet rock of the building. This enables caulking to be easily and effectively applied in the space between the back of the flashing and the bottom surfaces of an installed window to provide a superior seal.

Figure 4:
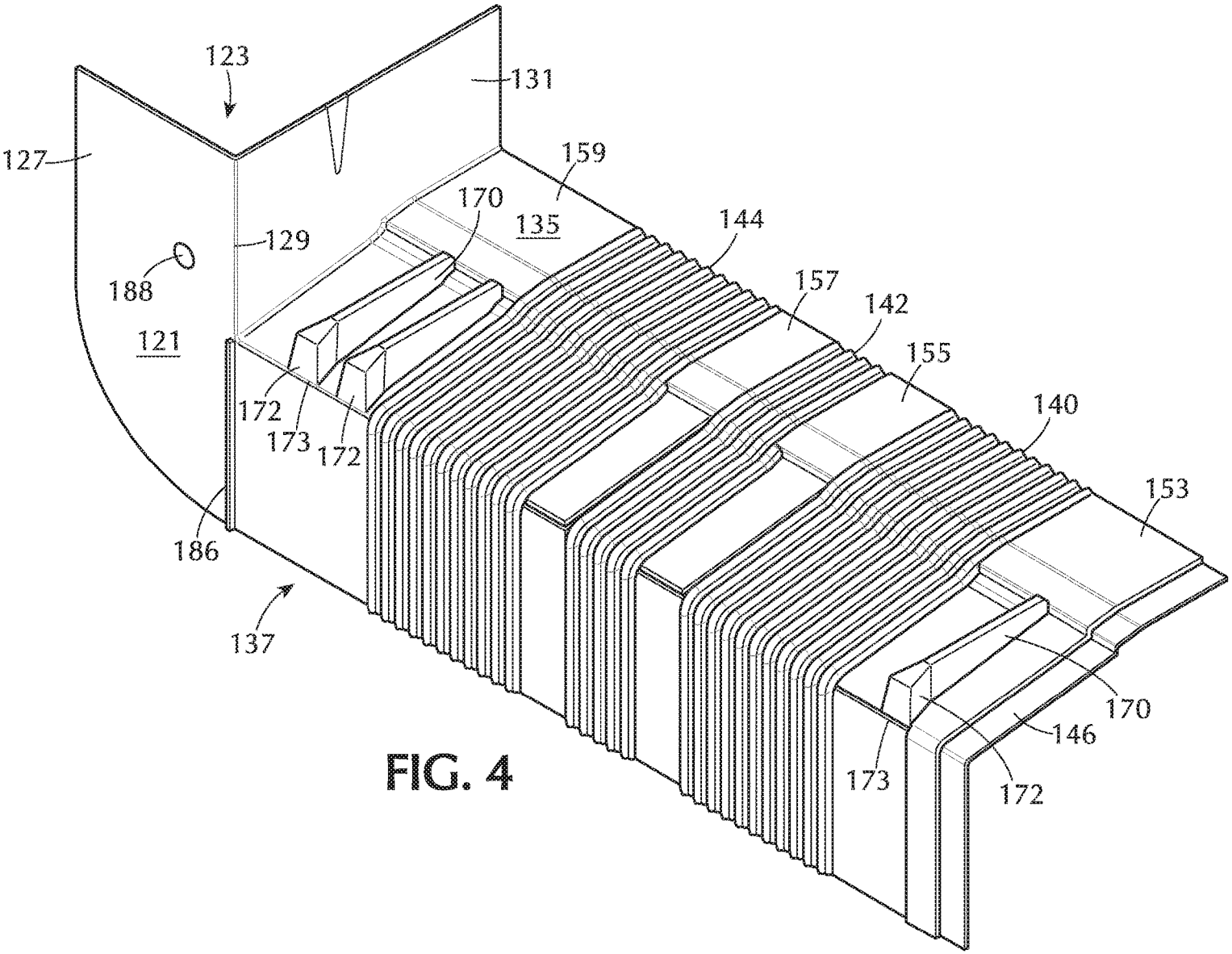
FIG. 4 is an orthographic view from above of the left hand end part of FIG. 2.
Figure 5:
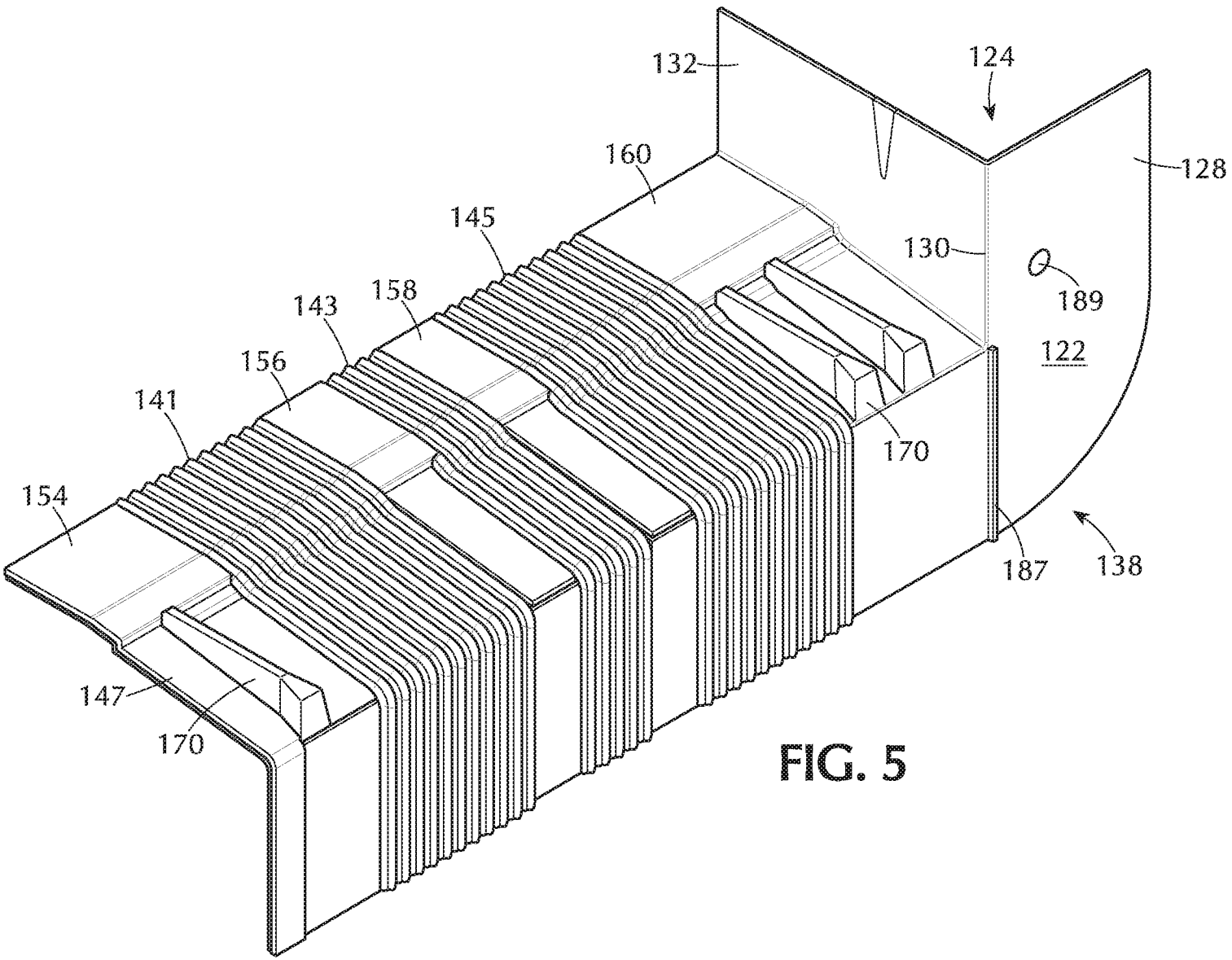
FIG. 5 is an orthographic view from above of the right hand end part of FIG. 3.
Figure 6:
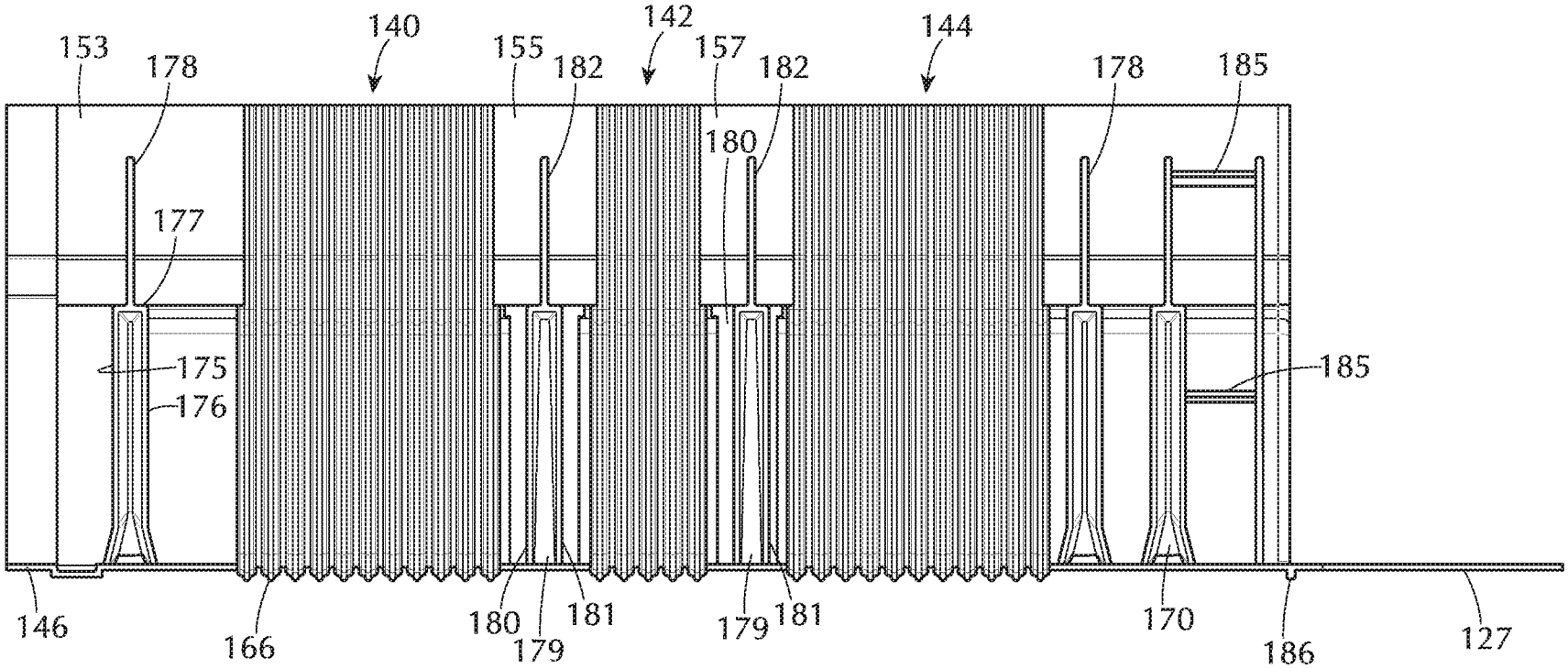
FIGS. 6 and 7 are bottom plan views of the left hand and right hand end parts, respectively.
Figure 7:
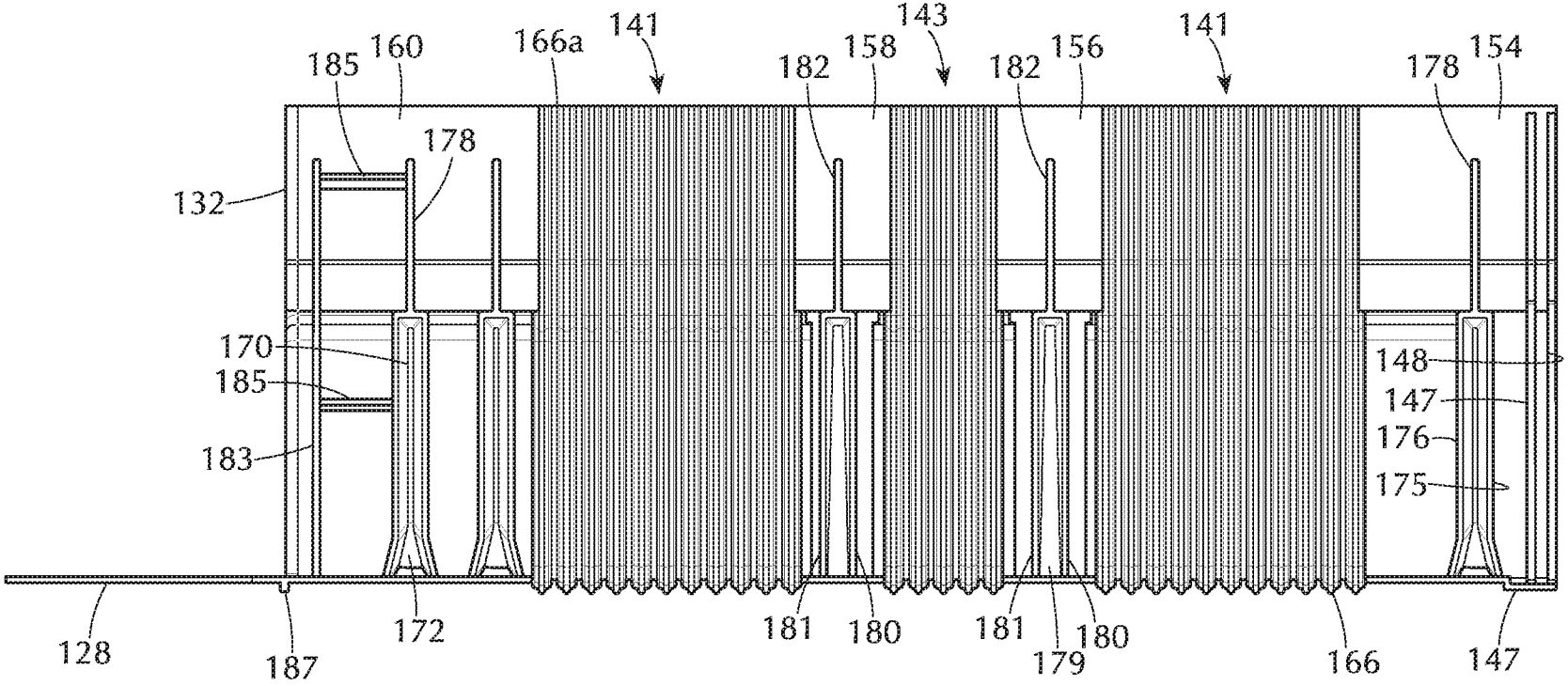
Figure 8:
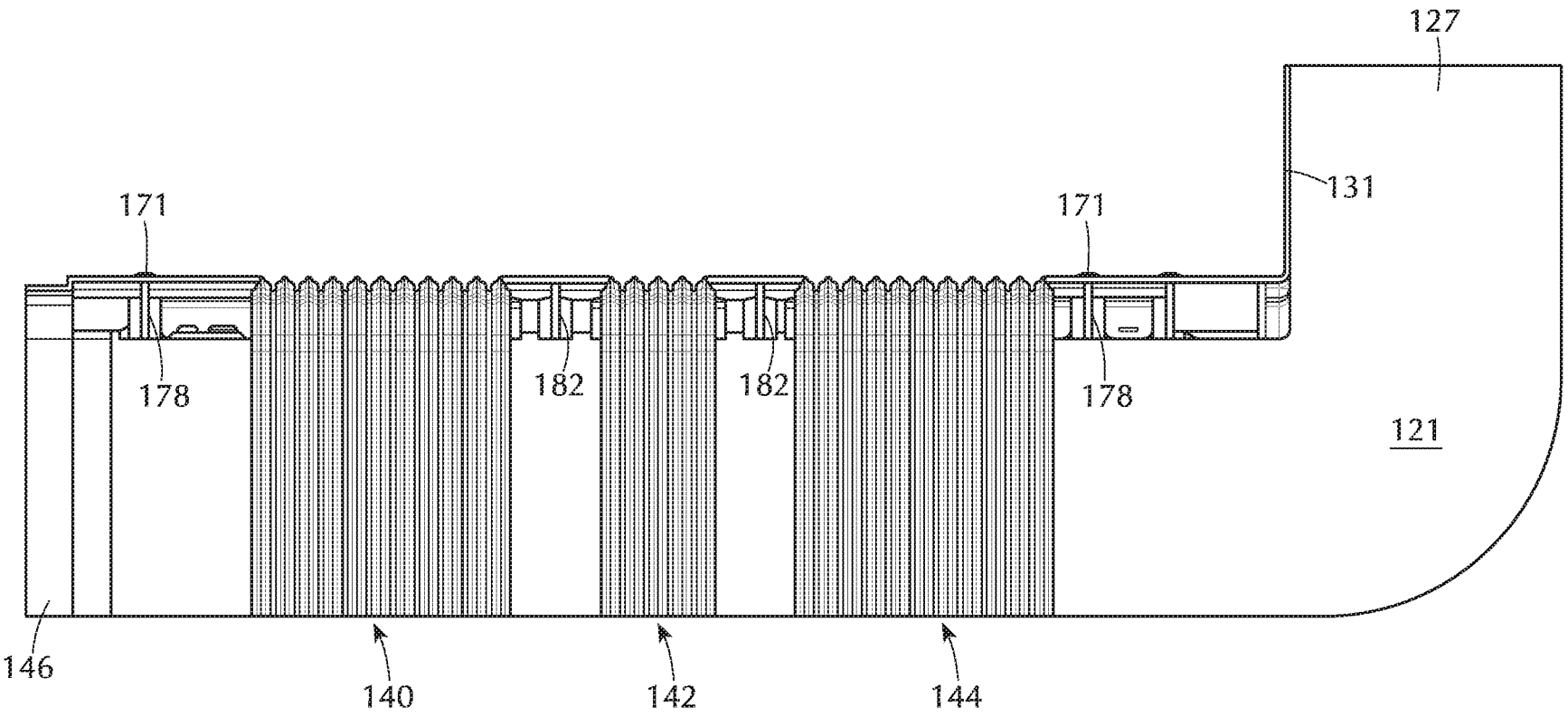
FIGS. 8 and 9 are back elevational views of the left hand and right hand end parts, respectively.

As indicated in FIGS. 4, 5, the individual accordion sections 140-145 are joined with panel sections 153-160, which extend downward in the front and rearwardly on the top, and serve to space and connect the accordion sections and also to join the outermost accordion sections 144, 145 to the respective corner structures 123, 124. The panel sections are substantially vertical in the front and are inclined at the desired 7°-8° angle extending rearward from the front corner. After the abrupt rise at 151, the panels continue rearward on the indicated incline for approximately ¾ inch (19 mm) after which the panels extend horizontally to the rear of the flashing While the upper portions of each of the panel sections 153-160 are configured with an abrupt rise at 151, as in FIGS. 15, 16, the accordion sections 140-145 are configured with a rise of similar height, but with the rise taking place in the form of an elongated (e.g., $3/8^{th}$ inch, 9.53 mm), shallow S-curve, as shown at 161 in FIG. 17.

Figure 10:
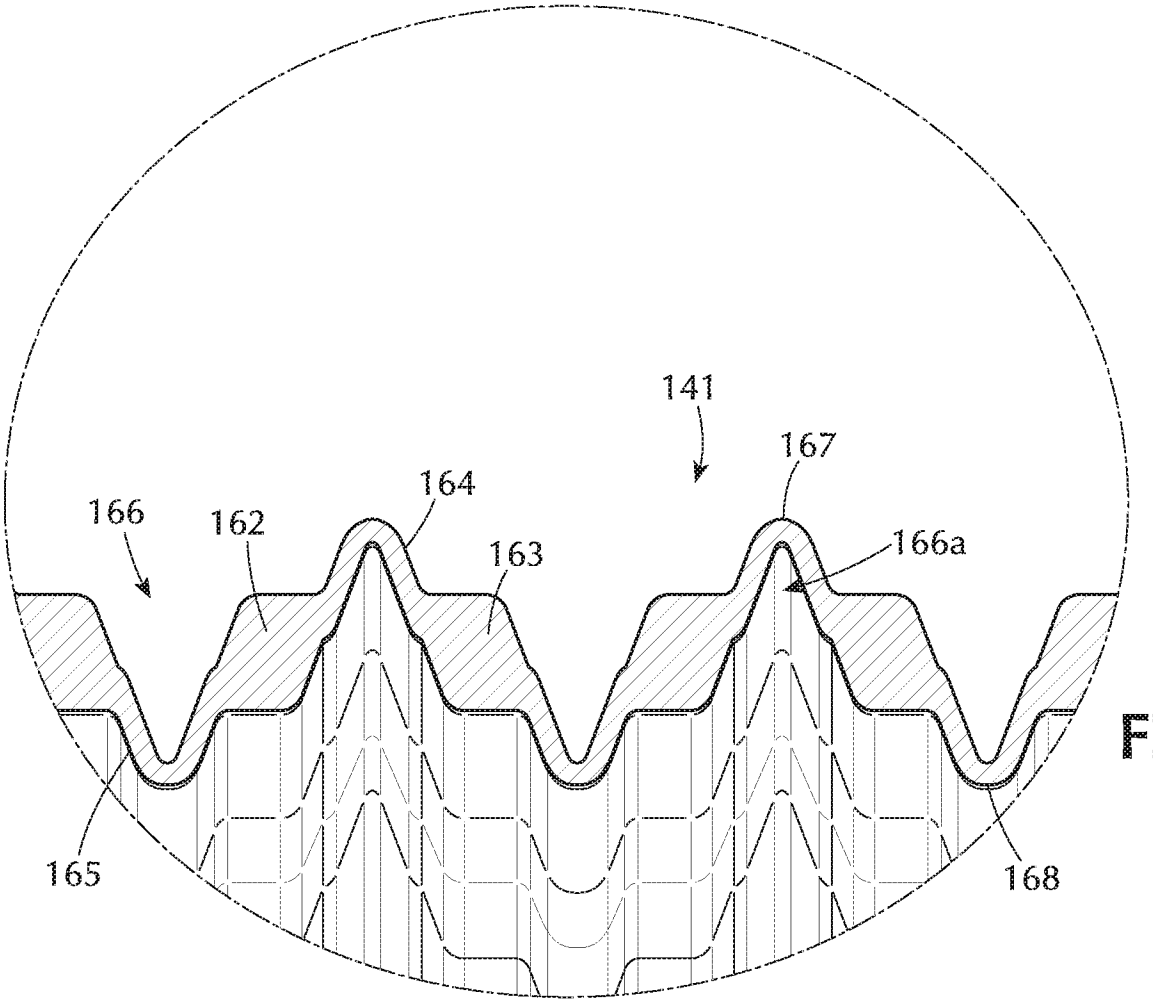
FIG. 10 is an enlarged, fragmentary detail view of the encircled portion 10 of FIG. 9 showing cross sectional details of a preferred form of accordion structure forming a significant part of the new flashing.

Pursuant to an aspect of the invention, the accordion sections 140-145 are of a unique construction and configuration comprised of a plurality of laterally flexibly connected panels 162, 163, joined as a series of V-shaped elements 166 and inverted V-shaped elements 166*a*, as indicated in FIG. 10. The individual accordion panels 162, 163 are connected on their outer lateral edges (upper edges as viewed in FIG. 10) by relatively thin connecting elements 164 of an inverted V-shaped configuration while their inner lateral edges are connected by similar, relatively thin connecting elements 165 of a V-shaped configuration. In a practical embodiment of the invention, the panels 162, 163 may have a thickness of 0.078 inch (1.98 mm) and a height (as measured vertically in FIG. 10) of 0.100 inch (2.54 mm). In the embodiment illustrated in FIG. 10 the panels 162, 163 have the cross sectional shape of a parallelogram.

Preferably, the connecting elements 164, 165 join adjacent accordion panels 162, 163 at adjacent corners of the panels, such that opposed, facing surfaces of the connecting elements are in general alignment with opposed, facing surfaces of the panels to which they are connected. The connected accordion panels 162, 163 and associated connecting elements 164, 165 form a series of V-shaped accordion elements 166, 166*a* facing alternately upward and downward as viewed in FIG. 10. The included angle made by the V-shaped elements 166, 166*a* may be about 42°. In a preferred embodiment, the connecting elements 164, 165 will have a thickness substantially less than that of the panels 162, 163, and preferably a thickness of 0.020 inch (5.08 mm) or about one-fourth the thickness of the panels. The connecting elements also may have inside and outside radii at their apices of 0.008 inch (0.20 mm) and 0.028 inch (0.71 mm), respectively. When the accordion sections are in a relaxed configuration, as reflected in FIG. 10, a preferred wave length, between adjacent apices on the same side, may be 0.354 inch (13.7 mm), and a preferred wave height, between adjacent apices on opposite sides, may be 0.23 inch (5.84 mm). The height of the individual V-shaped connecting elements 164, 165 may be 0.065 inch (1.65 mm).

Figure 18:
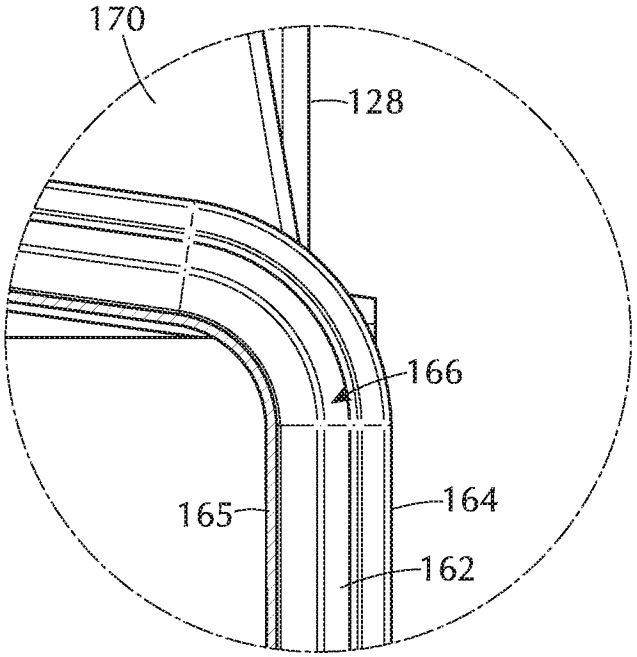
FIG. 18 is an enlarged detail view of the encircled portion 18 of FIG. 17, with details of the arcuate front corner structure of an accordion section.
Figure 17:
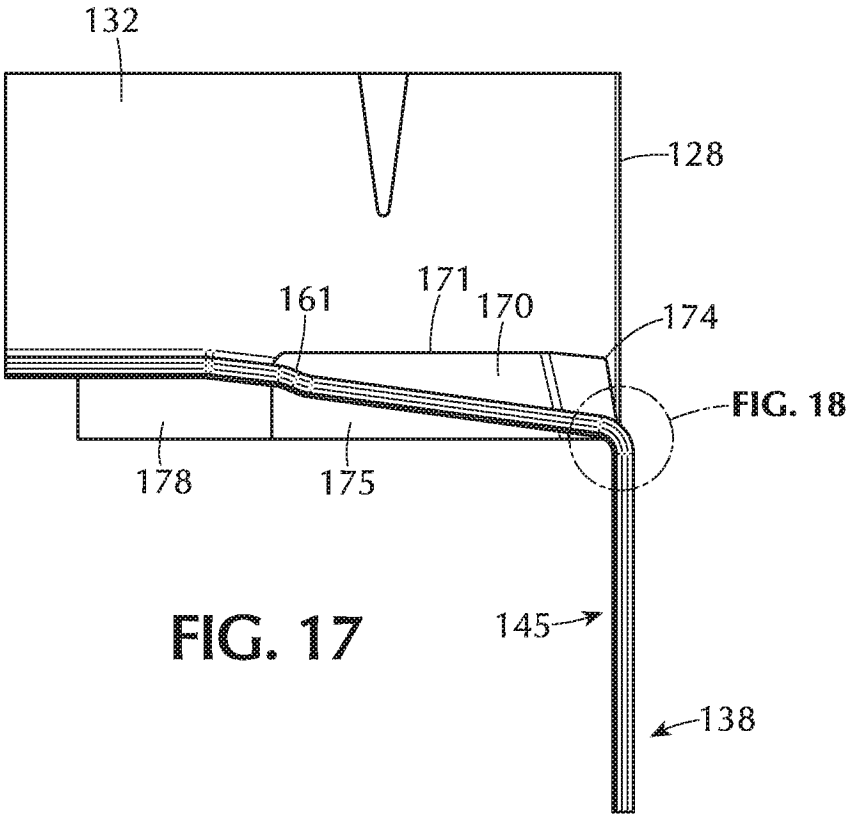
FIG. 17 is a cross sectional view of the right hand end part as taken generally on line 17-17 of FIG. 3, along a valley fold of an accordion section.

In a preferred embodiment of the invention, the V-shaped accordion elements 166, 166*a* extend continuously from the upper back edge of the flashing to the front bottom edge thereof, maintaining a substantially constant cross sectional configuration throughout their entire extent. The front corners of the V-shaped accordion elements 166, 166*a*, where the inclined upper portions meet the vertical lower portions, are of rounded contours, as illustrated in FIGS. 17 and 18. The ridges 167 and valleys 168 if the V-shaped accordion elements 166, 166*a* extend in common vertical planes from top to bottom and through the rounded front corner area. Preferably, at the front corner, the rounded contour of the accordion elements 166 may have an inside radius of 0.1875 inch (4.76 mm) and an outside radius of 0.418 inch (10.6 mm), maintaining a substantially constant cross section throughout the corner contours. The rounded front contours enable a more uniform flow of the plastic material throughout the accordion elements during the injection molding procedure, to provide uniform accordion action and long term reliability of the flashing. The indicated radii provide for good material flow during molding while not resulting in excessive displacement of the front corner of the flashing from the front corner of the rough framing. Such displacement may also be minimized by rounding off the front corner of the rough framing somewhat to accommodate all or part of the inside radii of the accordion sections.

Figure 11:
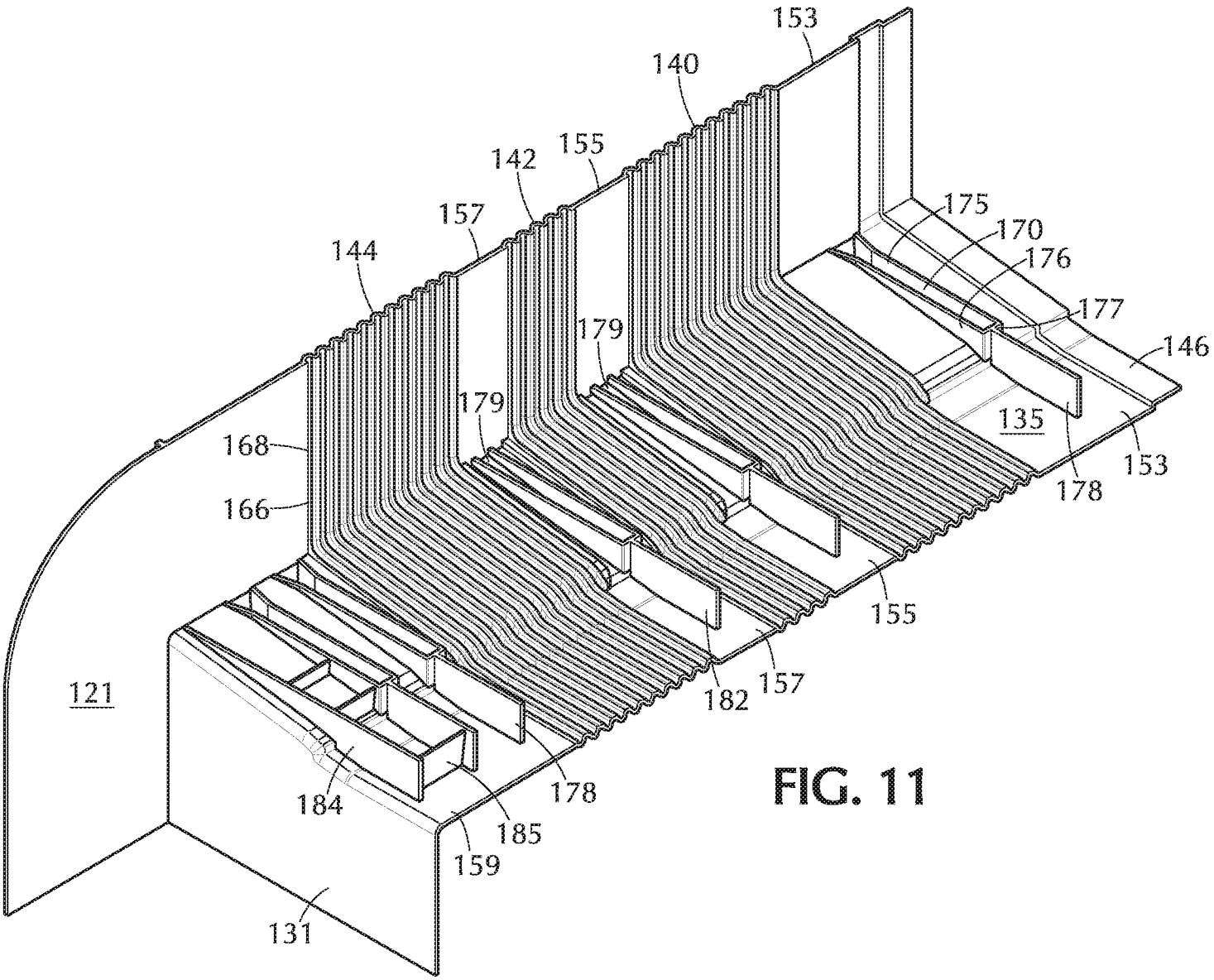
FIGS. 11 and 12 are orthographic views of the undersides of the left and right hand end parts, respectively.
Figure 12:
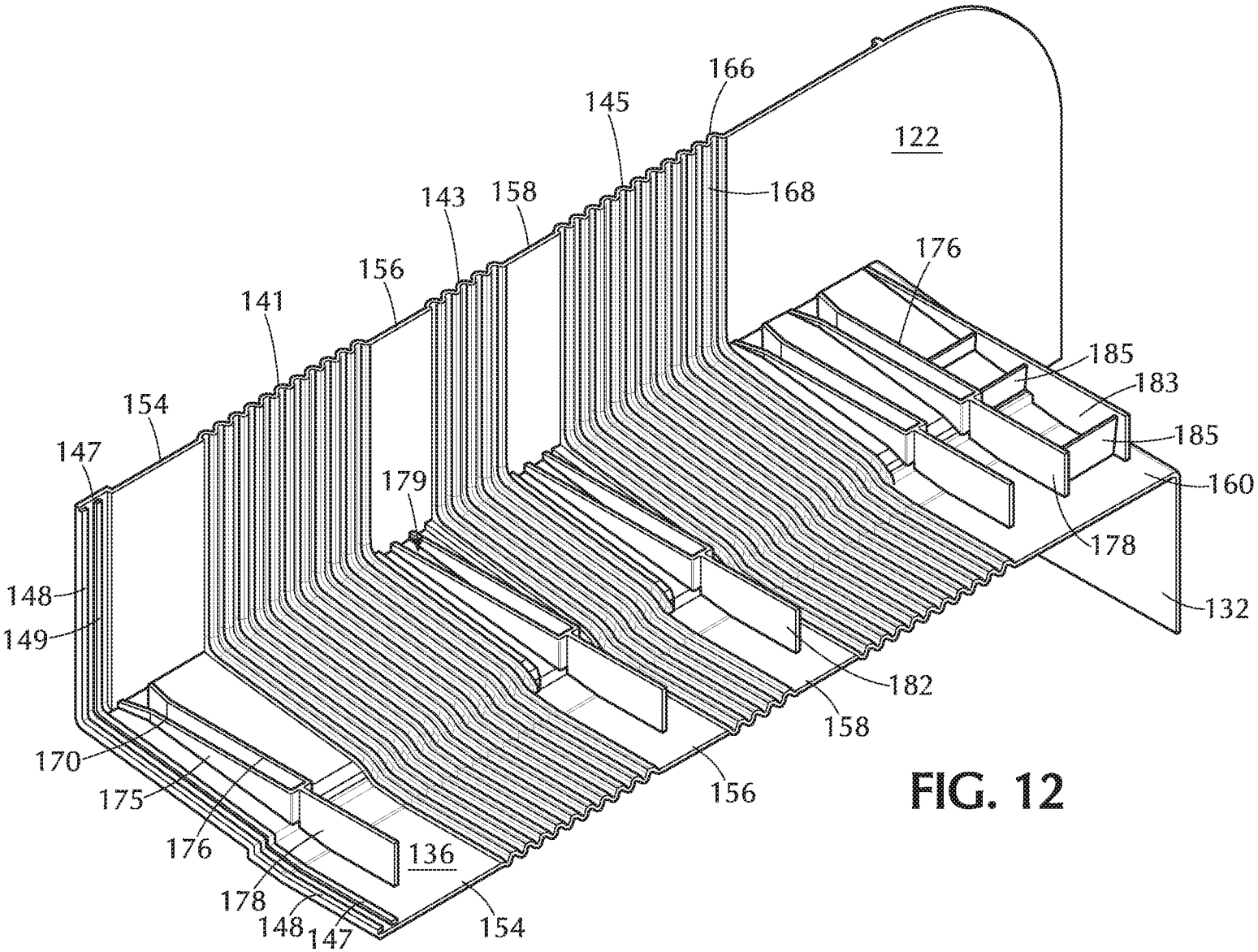
Figure 13:
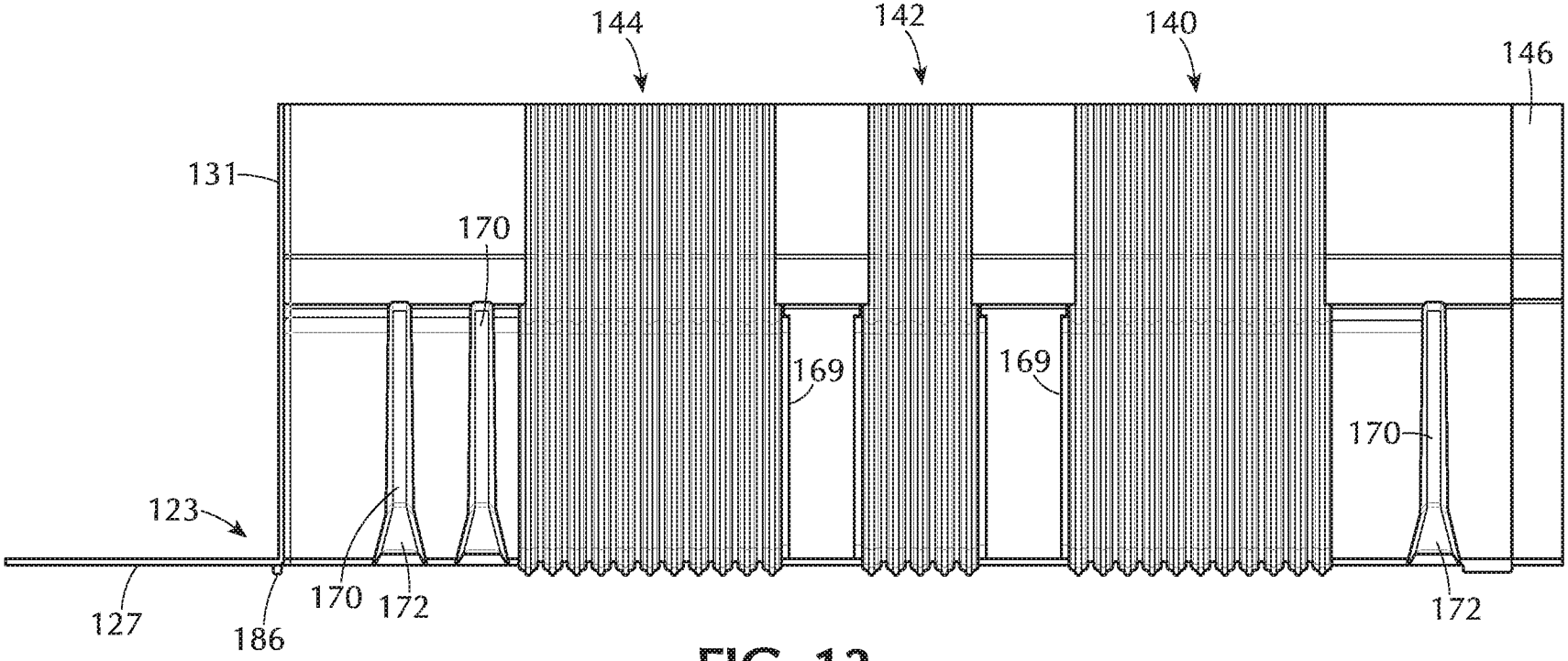
FIGS. 13 and 14 are top plan views of the left and right hand end parts, respectively.
Figure 14:
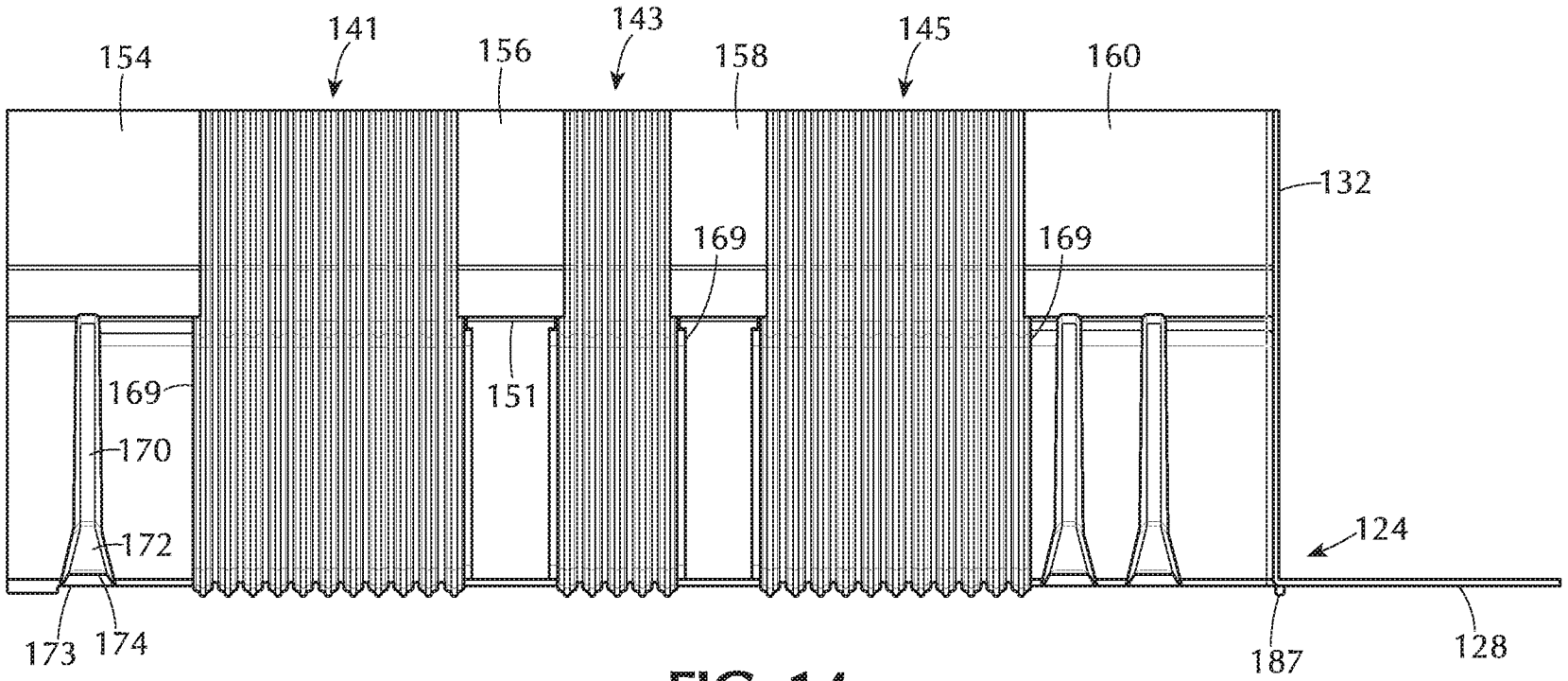

As indicated in FIGS. 11, 12, the vertical front portions of the accordion sections 140-145 are joined with the vertical front portions of the respective panel sections 153-160 in such a manner that the valleys 168 of the V-shaped accordion elements 166 lie in the vertical plane formed by vertical front portions the several panel sections. As a result, the V-shaped sections 166 project forwardly from the vertical plane of the adjacent panel sections. The inclined upper portions of the accordion sections 140-145, in the regions thereof in front of the abrupt rise 151, are also arranged such that their valleys 168 lie in a common inclined plane with the inclined front portions of the panel sections 153-160, such that the V-shaped elements 166 of the accordion sections project upwardly with respect to the inclined common plane of the adjoining panel sections 153-160. However, in rearward portions of the accordion sections, as the S-curve sections 161 thereof transition through the region of the abrupt rise 151 in the panel sections 153-160, the ridges 167 become aligned with the now more elevated planes of the back portions of the panel sections 153-160. As a result, in the back portions of the flashing the V-shaped accordion elements 166*a* project downwardly from the plane of the elevated rear portions of panel sections 153-160. As best seen in FIGS. 13 and 14, the transition of the accordion sections from projecting outwardly or upwardly from the adjacent panel sections 153-160, in front portions of the flashing, to projecting downwardly from rear portions of the panel sections, is accommodated by a discontinuation of the outermost halves 169 of the outermost V-shaped accordion elements 166, commencing in the area of the abrupt rise 151 and continuing to the rear edge of the flashing.

In the illustrated form of the invention, selected panel sections 153, 154, 159, 160 of the inclined top structures 135, 136 are provided with upwardly projecting support ribs 170 arranged to provide underlying support for a prefabricated window structure (not shown) installed above the flashing. Upper surface portions 171 of the ribs 170 are disposed horizontally at a level slightly above the tops of the accordion sections 140-145 and slightly above the highest levels of the panel sections 153-160, at the back edges thereof. The support ribs 170 extend from the front of the flashing and, in the illustrated embodiment, terminate at the abrupt rise 151. Preferably, the frontmost portions 172 of the support ribs are enlarged in width and angled slightly back from a lower front edge 173 of the rib and angled up slightly from an upper front edge 174 of the rib to the horizontal upper surface 171. See FIGS. 15, 16.

In a typical embodiment of the invention of the invention, a closely spaced pair of window support ribs 170 is provided adjacent to each corner structure 123, 124. For the support of windows larger than 24 inches (0.61 m), it is desirable to provide an additional pair of the support ribs at the center of the flashing, one on each of the end parts 121, 122, adjacent to the inner ends thereof. For smaller windows, such as 18 inches (0.46 m) and 24 inches (0.61 m), the inner support ribs can be omitted, with the windows being supported exclusively by the pairs of ribs 170 on the opposite corner structures 123, 124.

Figure 15:
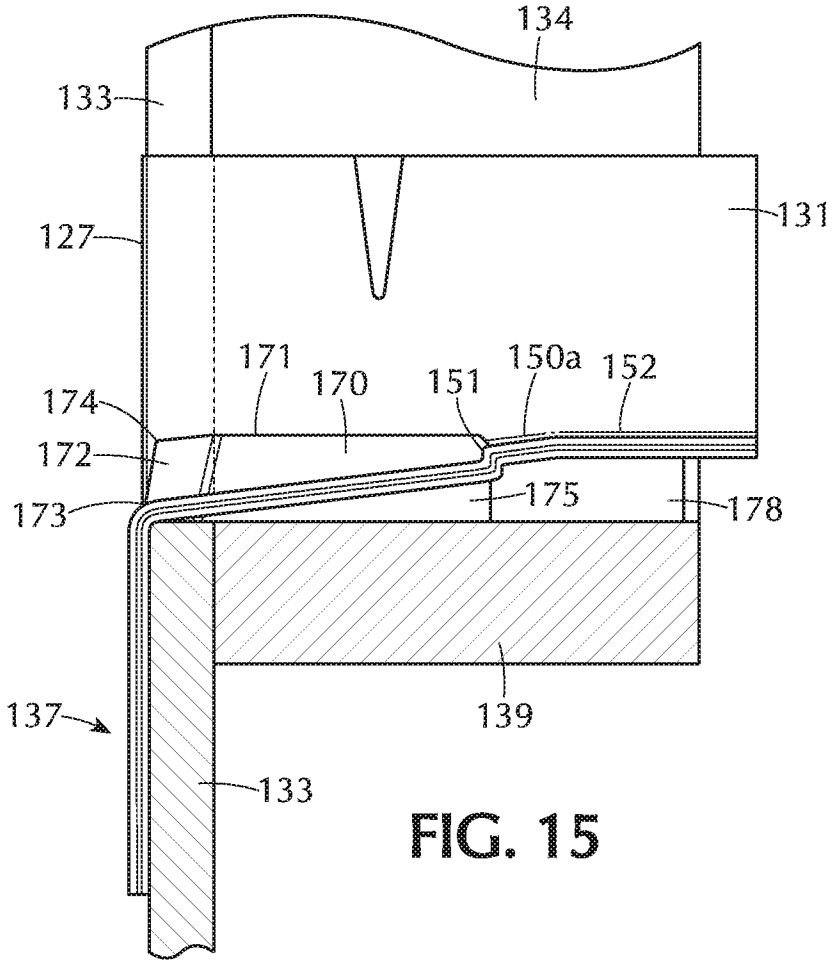
FIGS. 15 and 16 are end elevational views of the left and right hand end parts, respectively, with FIG. 15 showing the left hand end part as mounted on a sill plate of a rough framed opening.
Figure 16:
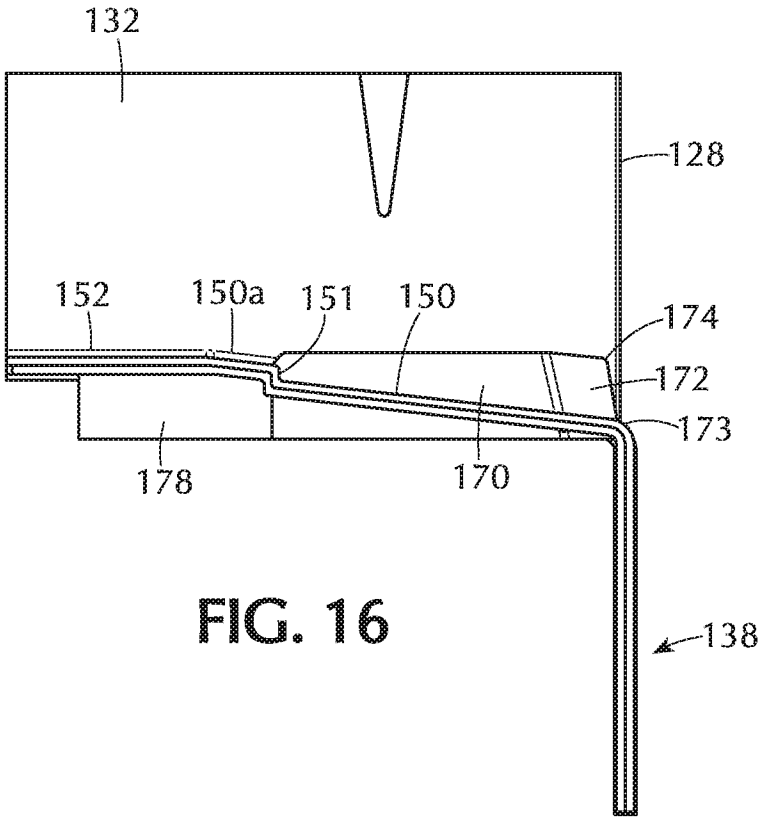

As indicated in views such as FIGS. 6-7 and 11-12, the window support ribs 170 are hollow and downwardly opening. Spaced apart sidewalls 175, 176 of the support ribs extend downward from the under sides of the flashing top structures 135, 136. Bottom edges of the side walls 175, 176 are disposed parallel to the upper surfaces of the ribs 170 and are designed to be seated horizontally on the upper surface of the sill plate 139, as indicated in FIG. 15, such that the weight of a prefabricated window, seated on the support ribs 170, is transmitted directly to the sill plate 139 via the underlying side walls 175, 176. The side walls 175, 176 also serve to support the upper front portions of the flashing spaced above the sill plate 139 and at the desired angle of incline. The back ends of the spaced apart side walls 175, 176 are connected by end walls 177, and support fins 178 extend rearwardly from the end walls 177, underneath rearward portions of the panels 153, 154 and 159, 160, to maintain these panel portions properly elevated above the sill plate.

In the flashing illustrated in FIGS. 1-18, the intermediate panels 155-158 are not provided on their upper sides with window support ribs corresponding to the ribs 170, as such are deemed unnecessary for the support of standard windows. However, the intermediate panels 155-158 are nevertheless provided on their undersides with supports 179 comprised of side walls 180, 181 of a configuration corresponding to side walls 175 and 176, and with support fins 182 corresponding in configuration and function to the support fins 178. The underside supports 179 engage the sill plate 139 and serve to maintain the top structures 135, 136 of the flashing at the desired forwardly slanted angle for proper drainage of liquid. In the illustrated embodiment of the invention, additional support walls 183, 184 are provided underneath the outermost panel sections 159, 160, in positions closely adjacent to the corner structures 123, 124 of the flashing. These additional support walls 183, 184 are joined with adjacent support walls 176 and associated fins 178 by a plurality of cross walls 185 (see FIGS. 11, 12). This end structure serves to assist in supporting the weight of a window carried by an adjacent pair of support ribs 170 at the outer ends of the flashing.

To advantage, the front structures 137, 138 of the flashing are provided with vertical ribs 187, 188 (FIGS. 1-5) which extend downward from the respective front corner edges 129, 130 to the bottom edges of the flashing. These ribs serve to block any laterally outward migration of water that may be flowing down the front face of the flashing adjacent to the opposite edges thereof.

Figure 19:
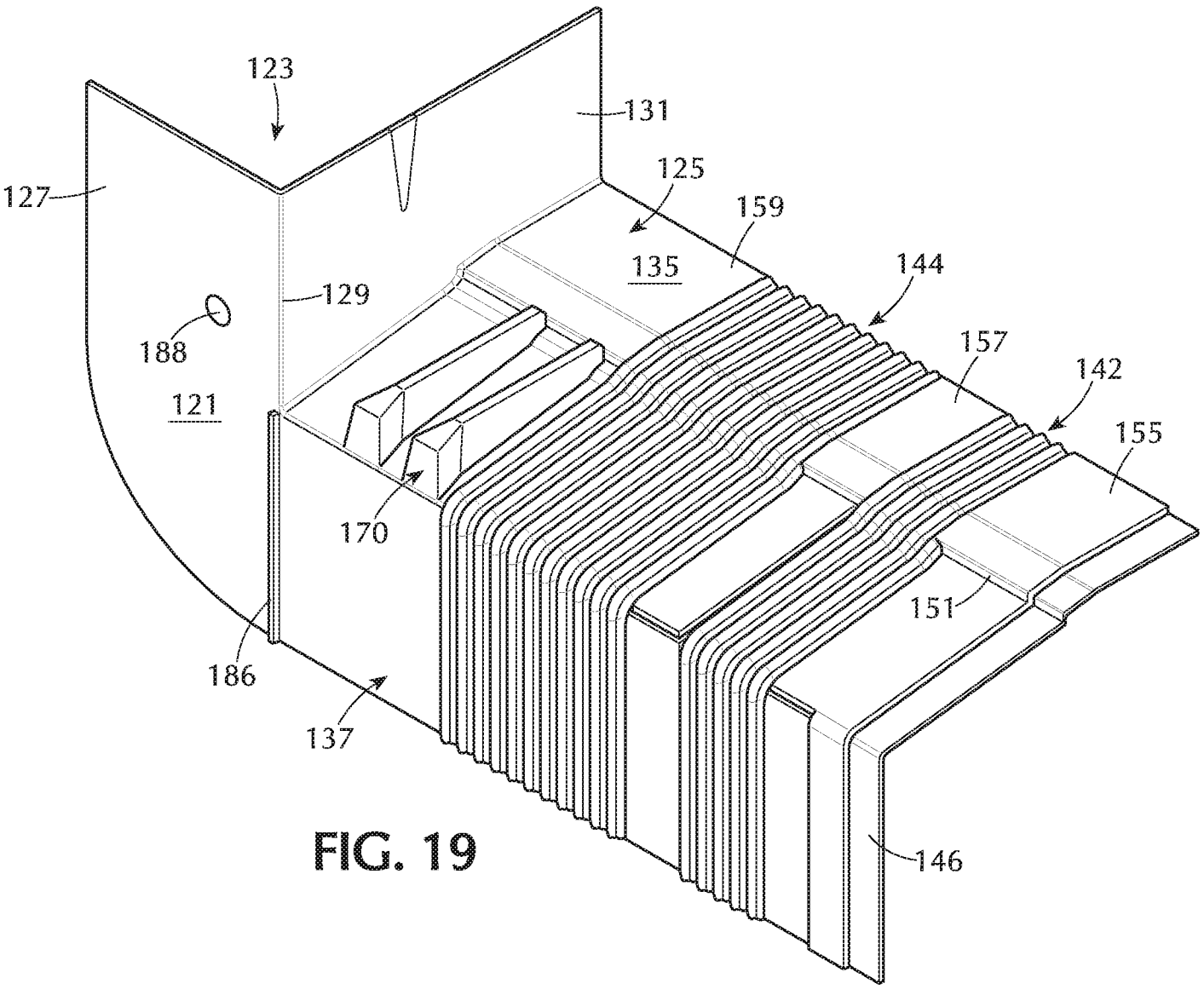
FIG. 19 is an orthographic view from above of a left hand end piece formed with two accordion sections.
Figure 20:
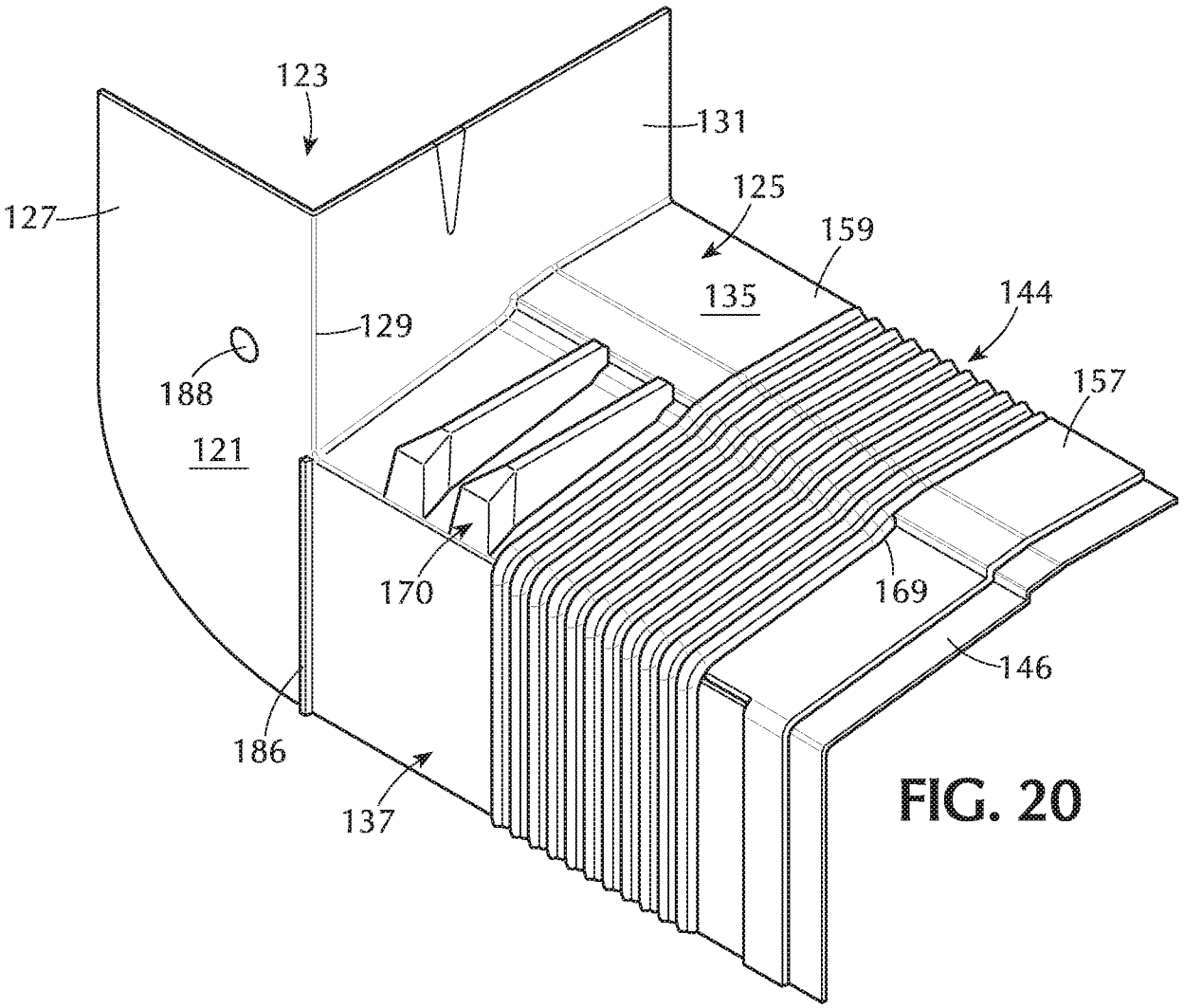
FIG. 20 is an orthographic view from above of a left hand end piece formed with one accordion section.

The flashing illustrated in FIGS. 1-18 is representative of a flashing of 36 inches (0.914 m) in nominal width. With reference to FIGS. 19 and 20, it will be understood that a flashing of nominal width of 24 inches (0.61 m) can be obtained by modifying the molds for producing the left and right flashing parts 121, 122 to eliminate the innermost accordion sections 140, 141 (FIG. 19), and a flashing of nominal width of 18 inches (0.457 m) can be obtained by modifying the molds to eliminate the accordion sections 142, 143 as well as the sections 140, 141 (FIG. 20). The 24 inch (0.61 m) and 18 inch (0.457 m) versions of the flashing are otherwise the same as the embodiment of FIGS. 1-14, and similar reference numerals are used to designate similar elements. For the 24 inch and 18 inch sizes, however, window supporting ribs 170 at the center of the flashing can be omitted as the pairs of support ribs adjacent to each corner are sufficient for the smaller window sizes.

Figure 21:
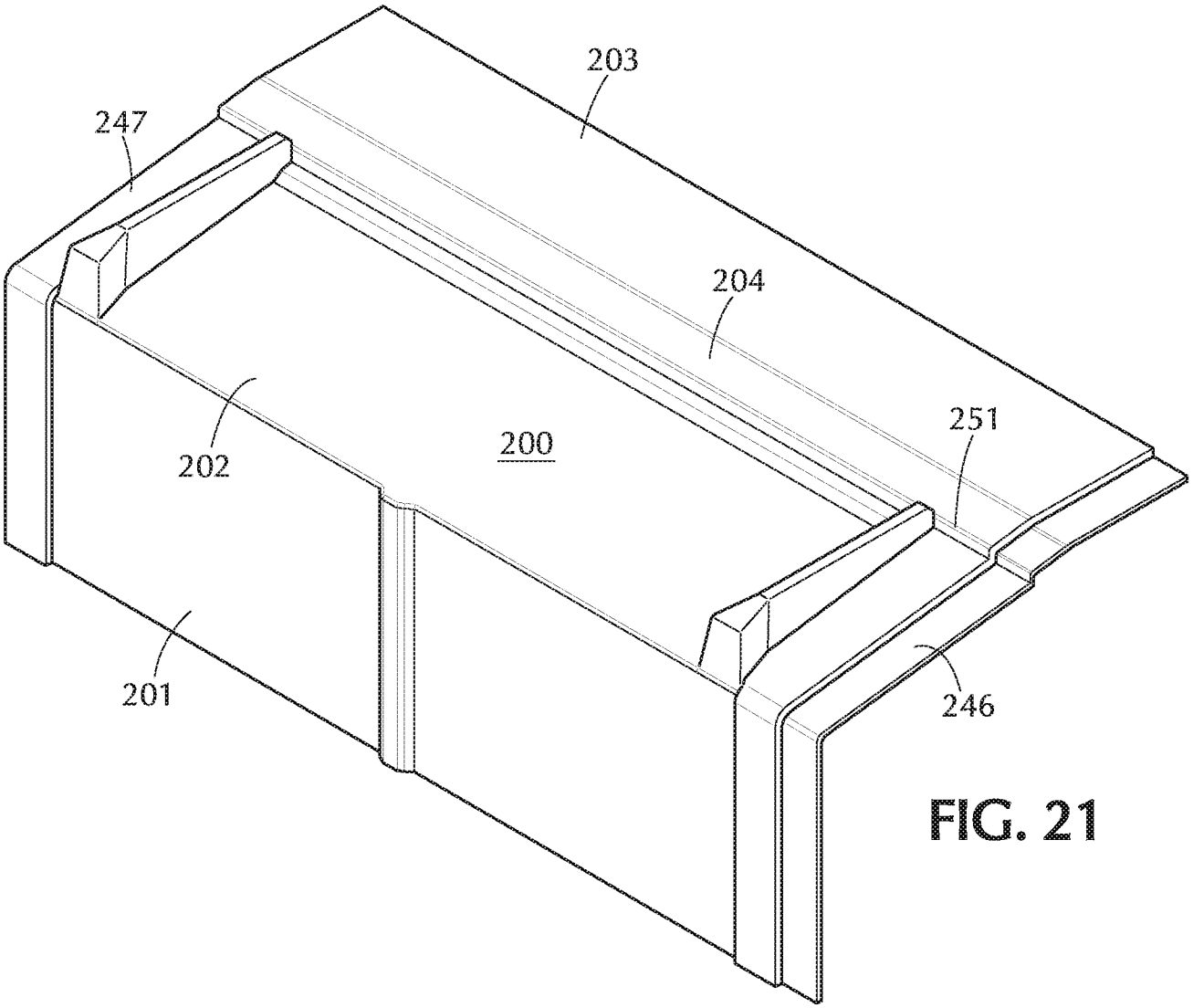
FIG. 21 is an orthographic view from above of a center extension part used in connection with flashings for wider windows.

As will be understood by those skilled in the art, elongated flashings for particularly wide windows may be constructed by inserting one or more center extensions 200 (FIGS. 21, 22) between two end parts 121, 122 of the maximum standard width (i.e., dimensioned for a 36 inch (0.914 m) rough framing). The center extensions 200, which can be of any suitable length, have a cross sectional configuration corresponding to that of the panel sections 153-160 (See FIG. 16). The extensions 200 comprise a vertical front panel 201, an inclined forward upper panel 202, and a generally horizontal back panel 203. The back of the inclined panel 202 joins with an abrupt vertical step 251, serving as a barrier against wind-driven water, and a short inclined transition panel 204 connected with the front of the back panel 203. At one end the extension is formed with an overlapping flange 247, formed with integral weld beads 248, 249, and at the other end the extension has an underlapping flange 246. The flanged end structures of the center extensions 200 correspond to those of the end parts 121, 122, enabling the extensions to be permanently secured to and sealed with a pair of opposed end parts, or with like center extensions, by the previously described linear friction welding procedure. An extended assembly thus will comprises a pair of end parts joined with one or more center extensions. The center extensions can of course be made of any suitable length compatible with economical molding procedures. It is contemplated that the flashing of the invention, using center extensions when necessary, will be provided in standard lengths suitable for standard window sizes from 18 inches (45.7 cm) to 12 feet (3.66 m) in width.

Figure 22:
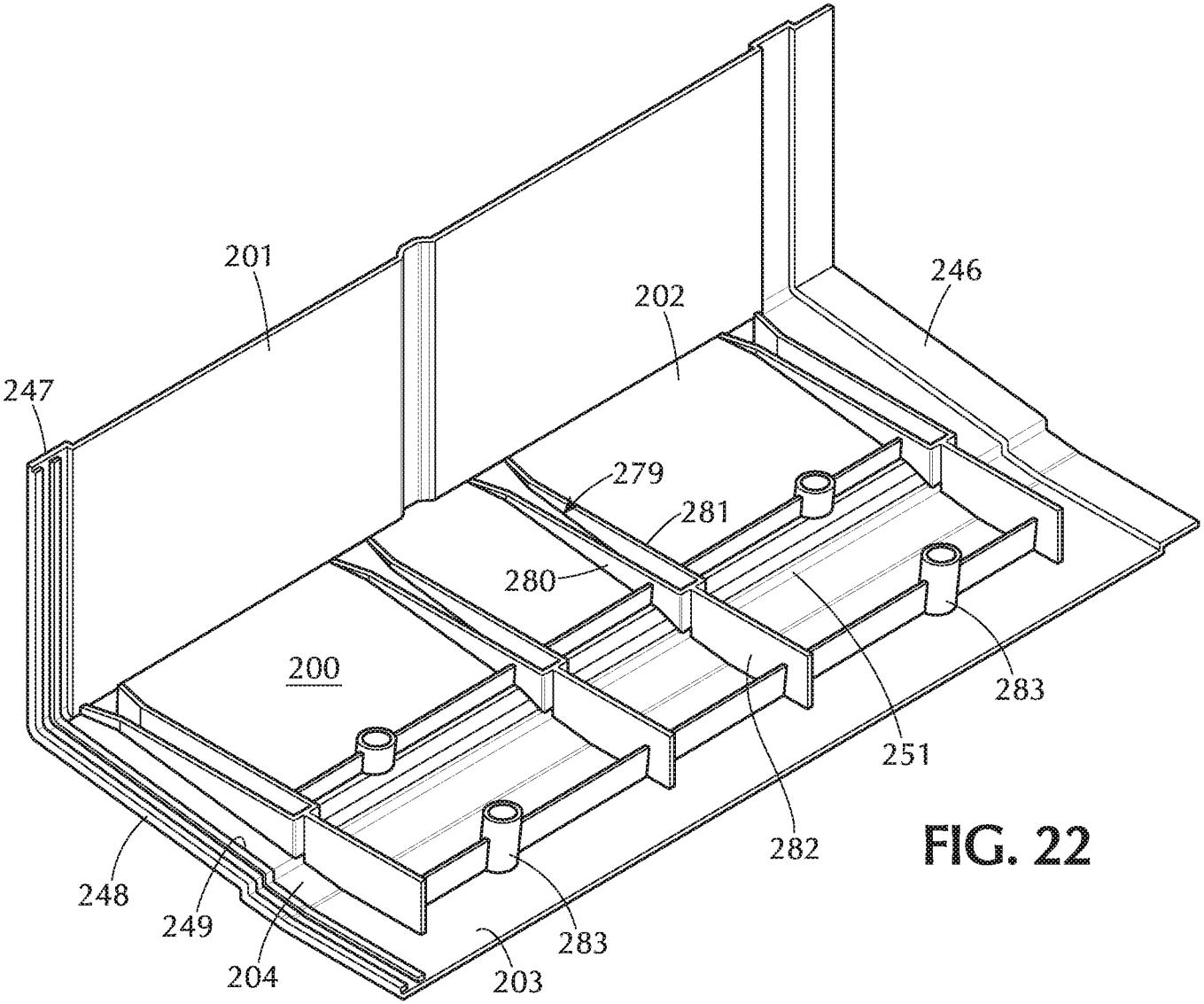
FIG. 22 is an orthographic view of the underside of the center extension part of FIG. 21.

The center extensions 200 preferably are provided with one or more window-supporting ribs 270, corresponding to the ribs 170 of the end parts. Additionally, the extensions 200 are provided with underside supports 279-282, which may correspond to the supports 179-182 underneath the intermediate panel sections 155-158 of the end parts, in order to maintain upper portions of the extensions elevated at the back and disposed at the desired angle of tilt toward the front. Support tubes 283 also may be positioned between the underside supports 179-182 as indicated in FIG. 22.

It is contemplated that the center extensions 200 will not be provided with accordion sections because the accordion sections 140-145 provided on the end parts 120, 121 provide adequate width expansion for even the longest flashings. In this respect, regardless of the width of the rough framing, the flashings for reception therein can be provided in a factory width which is an inch or two (preferably not more than three inches) less than the framing width, such that the standard accordion sections 140-145 of the basic end parts 121, 122 for a 36 inch window provide more than adequate width expansion to accommodate the intended installation procedure as described herein.

Mounting of the new flashing is simple and extremely fast. A flashing is selected at a provided length somewhat narrower than the nominal width of the opening defined by the rough framing. The flashing is placed on the sill plate 139, and pressed to one side of the opening and held while a fastener, such as a self-tapping screw, is installed to secure one side of the flashing to the framing. Preferably, the fastener is installed through the front-facing panel (127 or 128) and into the outer sheathing 133. To facilitate the procedure, the front panels 127, 128 can be provided with surface differentiation in small areas 186, 189 to indicate to the workmen an optimum location for the fastener to be applied. After the flashing has been secured at one side of the framing, the opposite corner of the flashing is pressed toward and into contact with the opposite side of the rough opening. The accordion sections 140-145 expand as necessary to accommodate elongation of the flashing to establish contact with the opposite side. While the flashing is held in this elongated configuration, a second fastener is inserted through the front panel (127 or 128) to secure it to the sheathing 133. From start to finish, the installation requires just a few seconds of time.

In typical home construction, the exterior sheathing 133 is covered with a weather barrier, such as DuPont Tyvek® or similar (not illustrated herein) which, when initially applied, spans over the rough framed window openings. Before installing the flashing in the opening, cuts are made in the weather barrier, where it spans the opening, to form inwardly foldable flaps. Preferably, when planning to install the flashing of the invention, flaps are cut at the opposite sides in such manner that the vertical framing members 134 (FIG. 15) can be completely covered thereby except for a short space of approximately one inch (2.54 cm) at the bottom. Before the weather barrier and its flaps are secured in place at the sides of the opening, the flashing is installed and fastened as above described, with the front-facing panels 127. 128 inserted underneath the weather barrier at each side of the opening. The side flaps are then folded over the inwardly facing panels 131, 132 of the flashing and over the exposed vertical framing members 134 above the flashing, preferably right up to the header (not shown) that extends between the framing members at the top. This assures that any leakage between an installed prefabricated window and the barrier flaps covering the vertical framing members will be directed to the inclined surfaces of the flashing and thence to the exterior of the protected structure.

The new variable width flashing can be used in connection with new construction and also in connection with the installation of replacement windows. For use in connection with replacement windows, the vertical portions of the sill cover, including accordion sections, can be made shorter, to extend downward about an inch (2.54 cm) rather than a more typical 4 inches (10.2 cm), and the other front panels are similarly made at a shorter vertical height. The narrower front margins are provided to accommodate previous construction features found when replacing existing windows. The functional features of the modified flashing remain the same as described above.

In any of its forms illustrated and described herein, the invention represents a significant advance in the field of sill pan flashings by enabling the flashing to be shipped and installed in one piece, without requiring cutting and fitting at the job site and entirely avoiding the otherwise necessary (but only partly effective) step of performing on-site sealing of a joint between two (or more) individual flashing parts. By providing one or more integral accordion sections across the width of the flashing, a one-piece flashing, as received from the factory, can be quickly installed—frequently in less than a minute—with complete assurance against leakage from improperly sealed joints and/or deterioration of the sealing materials. The flashing can be made to almost any length by combining a pair of end parts 121, 122 with additional extension parts 200, with or without additional accordion sections and/or window support ribs, all fully and permanently bonded and sealed at the factory. Nothing is left to be done at the job site except to fasten the flashing in place with a couple of self-tapping screws, nails, staples or the like.

It will be understood that the preferred embodiments of the invention herein illustrated and described are intended to be illustrative of the invention and not in limitation thereof. Accordingly, reference should be made to the following appended claims in determining the full scope of the invention.

What is claimed is:

1. A one-piece, laterally adjustable sill pan flashing installable in one piece in a framed opening, where the framed opening includes spaced apart side frame members and a sill plate member extending between the side frame members, said flashing comprising, a sill plate cover including an inclined upper portion, extending downwardly and forwardly and configured to extend over the sill plate member, and a front portion extending downward from a front of said upper portion, said sill plate cover including one or more width adjustable accordion sections, said one or more accordion sections being extendable in width during installation to enable respective end portions of said sill plate cover to be positioned against and secured to opposite sides of the framed opening, said inclined upper portion of said sill plate cover including support elements adjacent opposite ends thereof defining a support plane configured to support a window or door unit, said sill plate cover being configured such that at least rear portions of said sill plate cover, including rear portions of said accordion sections, are supported in elevated relation to said sill plate member, said one or more accordion sections comprising a plurality of flexibly connected panels of predetermined thickness joined along laterally adjacent edges thereof by flexible connecting sections forming a succession of integrally joined V-shaped elements defining successive ridges and valleys, said flexible connecting sections being of a thickness substantially less than said predetermined thickness, said one or more accordion sections having a cross sectional configuration with a wave height determined by a height between apices of said ridges and valleys, a front corner region at which inclined upper portions of said accordion sections join with downwardly extending front portions thereof being in the form of a transitional curve maintaining the cross sectional configuration of said V-shaped elements throughout a transition from said inclined portions to said front portions of said accordion sections.

2. The adjustable sill pan flashing according to claim 1, wherein the thickness of said flexible connecting sections is about ¼ of said predetermined thickness.

3. The adjustable sill pan flashing according to claim 2, wherein said arcuate transition curve has an inside radius of about 0.188 inch (4.78 mm) and an outside radius equal to said inside radius plus said wave height.

4. The adjustable sill pan flashing according to claim 3, wherein said wave height is about 0.230 inch (5.84 mm).

5. The adjustable sill pan flashing according to claim 1, wherein the inclined and front portions of each of the apices of said V-shaped elements lie in common vertical planes.

6. The adjustable sill pan flashing according to claim 1, wherein the support plane defined by said support elements is elevated with respect to accordion sections to support a window or door unit above said accordion sections.

7. The adjustable sill pan flashing according to claim 1, wherein said flashing is formed by injection molding.

8. The adjustable sill pan flashing according to claim 7, wherein said flashing is formed of a thermoplastic olefin alloy.

9. The adjustable sill pan flashing according to claim 7, wherein said flashing is molded in two parts comprising a left hand side and a right hand side, and said parts are joined together by linear friction welding.

10. The adjustable sill pan flashing according to claim 9, wherein one of said parts is formed at an inner edge thereof with a welding flange extending from a back of said inclined portion to a bottom of said front portion, the other of said parts is formed at an inner edge thereof with one or more weld beads coextensive with and facing said welding flange and positioned for contact with said welding flange, and said one or more weld beads are fused with said welding flange to permanently join said parts and form a seal therebetween.

11. The adjustable sill pan flashing according to claim 10, wherein said one or more weld beads comprise at least two weld beads positioned in parallel and spaced apart relation.

12. The adjustable sill pan flashing according to claim 7, wherein said flashing is molded in three parts comprising a left hand side, a right hand side, and a center extension, and said three parts are joined together by linear friction welding.

13. The adjustable sill pan flashing according to claim 1, wherein said flashing includes corner structures at each side thereof adapted to be secured to the opposite sides of said framed opening, opposite lateral sides of said one or more accordion sections are joined with connecting panels which connect adjacent ones of said one or more accordion sections to each other and connect outermost ones of said one or more accordion sections to corner structures, said inclined upper portion of said sill plate cover comprising a front portion and a rear portion, the connecting panels of said inclined upper portion having an abrupt rise from said front portion to said rear portion thereof, said rear portion including an inclined portion extending upwardly and rearwardly from said abrupt rise and a horizontal portion extending rearwardly from said inclined portion.

14. The adjustable sill pan flashing according to claim 13, wherein said accordion sections, in a region of said abrupt rise, transitioning through an elevation change at said region in the form of a shallow S-curve.

15. The adjustable sill pan flashing according to claim 13, wherein each of said connecting panels is provided on an underside thereof with a support structure configured to maintain rear portions of said connecting panels elevated above a sill plate member and disposed at an incline with respect thereto.

16. The adjustable sill pan flashing according to claim 15, wherein at least certain of said connecting panels have support elements, for the support of a door or window unit, positioned directly above support structures for said panels.

17. A one-piece, laterally adjustable sill pan flashing installable in one piece in a framed opening, where the framed opening includes opposite side frame members and a sill plate member extending between the side frame members, which comprises, a sill plate cover including an inclined upper portion, extending downwardly and forwardly and configured to extend over a top of the sill plate member, and a vertical front portion extending downward from a front of said inclined upper portion, said sill plate cover including one or more width adjustable accordion sections and connecting panels connected to lateral edges of said one or more accordion sections, said accordion sections and said connecting panels each comprising inclined upper portions and vertical front portions, the inclined upper portion of said sill plate cover comprising a forward portion and a rearward portion, said rearward portion being elevated with respect to said forward portion, and upper portions of said connecting panels being formed with an abrupt rise from forward portions of said connecting panels to elevated rearward portions thereof, upper and front portions said one or more accordion sections comprising a plurality of V-shaped elements defining successive ridges and valleys, said accordion section front portions being positioned such that the valleys thereof lie substantially in a plane defined by vertically extending connecting panels included in the vertical front portion of said sill plate cover, whereby ridges of said accordion section front portions extend forwardly from the vertical front portions of said connecting panels, accordion section rearward portions included in the rearward portion of said inclined upper portion of said sill plate cover being positioned such that ridges of such accordion section rearward portions lie substantially in a plane defined by adjacent connecting panels of the rearward portion of said inclined upper portion, whereby the ridges of said accordion section rearward portions are substantially aligned with said adjacent connecting panels and the valleys of said accordion section rearward portions extend downwardly from said adjacent connecting panels.

18. The adjustable sill pan flashing according to claim 17, wherein said one or more accordion sections comprise a plurality of flexibly connected panels defining said plurality of ridges and valleys, and laterally outermost ones of said flexibly connected panels are discontinued in a region commencing adjacent said abrupt rise and extending to a back edge of said sill plate cover such that, in said region, said one or more accordion sections are connected to said adjacent connecting panels at said ridges.

* * * * *